US011469562B2

(12) United States Patent
Takao et al.

(10) Patent No.: US 11,469,562 B2
(45) Date of Patent: Oct. 11, 2022

(54) ELECTRICAL CONNECTOR WITH CENTER CONDUCTOR

(71) Applicant: I-PEX Inc., Kyoto (JP)

(72) Inventors: Hirofumi Takao, Tokyo (JP); Yoichi Hashimoto, Tokyo (JP); Li Yao Lin, Tokyo (JP)

( * ) Notice: Subject to any disclaimer, the term of this patent is extended or adjusted under 35 U.S.C. 154(b) by 0 days.

(21) Appl. No.: 17/005,315

(22) Filed: Aug. 28, 2020

(65) Prior Publication Data

US 2021/0066873 A1 Mar. 4, 2021

(30) Foreign Application Priority Data

| | | |
|---|---|---|
| Aug. 30, 2019 | (JP) | JP2019-158221 |
| Mar. 13, 2020 | (JP) | JP2020-043676 |
| Mar. 31, 2020 | (JP) | JP2020-065125 |

(51) Int. Cl.

| | |
|---|---|
| ***H01R 43/02*** | (2006.01) |
| ***H01R 24/40*** | (2011.01) |
| ***H01R 4/02*** | (2006.01) |
| ***H01R 13/6581*** | (2011.01) |

(52) U.S. Cl.

CPC ..... *H01R 43/0207* (2013.01); *H01R 4/023* (2013.01); *H01R 4/029* (2013.01); *H01R 13/6581* (2013.01); *H01R 24/40* (2013.01)

(58) Field of Classification Search

CPC ..... H01R 43/0207; H01R 4/02; H01R 43/02; H01R 2103/00

See application file for complete search history.

(56) References Cited

U.S. PATENT DOCUMENTS

| | | | | |
|---|---|---|---|---|
| 9,941,646 | B1 * | 4/2018 | Hashimoto | H01R 13/648 |
| 2005/0056452 | A1 | 3/2005 | Mita et al. | |
| 2016/0199932 | A1 | 7/2016 | Kern | |
| 2018/0069335 | A1 | 3/2018 | Hashimoto | |
| 2018/0102598 | A1 | 4/2018 | Hashimoto et al. | |
| 2018/0102616 | A1 | 4/2018 | Hashimoto et al. | |
| 2019/0052031 | A1 | 2/2019 | Takahashi | |

FOREIGN PATENT DOCUMENTS

| | | |
|---|---|---|
| CN | 106877041 | 6/2017 |
| CN | 107809021 | 3/2018 |
| CN | 107919555 | 4/2018 |
| CN | 109390817 | 2/2019 |
| JP | H8-096899 | 4/1996 |
| JP | H9-115558 | 5/1997 |
| JP | 2006-164791 | 6/2006 |
| JP | 2013-222685 | 10/2013 |

(Continued)

*Primary Examiner* — Phuong Chi Thi Nguyen

(74) *Attorney, Agent, or Firm* — Soei Patent & Law Firm

(57) ABSTRACT

A method of manufacturing an electrical connector includes: contacting an end portion of a center conductor exposed in an end portion of a coaxial cable having the center conductor with a conductive contact; applying ultrasonic vibration to the end portion of the center conductor and the contact to join the end portion of the center conductor and the contact each other; and accommodating the contact in an insulation housing after the end portion of the center conductor and the contact are joined to each other, and covering at least a part of a joint of the end portion of the center conductor and the contact with the insulation housing.

19 Claims, 36 Drawing Sheets

(56) References Cited

FOREIGN PATENT DOCUMENTS

| | | |
|---|---|---|
| JP | 2014-127398 | 7/2014 |
| JP | 2015-130266 | 7/2015 |
| JP | 2018-060726 | 4/2018 |
| JP | 2018-060727 | 4/2018 |
| JP | 2018-116862 | 7/2018 |
| WO | 2015/044140 | 4/2015 |

* cited by examiner

ELECTRICAL CONNECTOR WITH CENTER CONDUCTOR

CROSS-REFERENCE TO RELATED APPLICATIONS

This application claims the benefit of priority from Japanese Patent Application No. 2019-158221, filed on Aug. 30, 2019, Japanese Patent Application No. 2020-043676, filed on Mar. 13, 2020, and Japanese Patent Application No. 2020-065125, filed on Mar. 31, 2020, the entire contents of which are incorporated herein by reference.

FIELD

An electrical connector and a method of manufacturing an electrical connector.

BACKGROUND

Generally, in various electronic devices or electric devices such as smartphones and tablet computers, connecting a signal transmission coaxial cable to a wiring board via an electrical connector is widely performed. For example, Japanese Unexamined Patent Publication No. 2018-60727 proposes applying ultrasonic vibration when performing a step of connecting a center conductor of the coaxial cable to a conductive contact (a terminal) in such an electrical connector. In a manufacturing method disclosed in Japanese Unexamined Patent Publication No. 2018-60727, first, the contact (the terminal) is fixed to a housing, the center conductor of the coaxial cable is then brought into contact with the contact (the terminal), a jig such as a horn or an anvil is then inserted into the housing, and ultrasonic vibration is applied in a state in which the center conductor of the coaxial cable and the contact (the terminal) are interposed between the horn and the anvil.

SUMMARY

An example method of manufacturing an electrical connector disclosed herein may include contacting an end portion of a center conductor exposed in an end portion of a coaxial cable having the center conductor with a conductive contact. The method may further include applying ultrasonic vibration to the end portion of the center conductor and the contact to join the end portion of the center conductor and the contact to each other. The method may further include accommodating the contact in an insulation housing after the end portion of the center conductor and the contact are joined to each other, and covering at least a part of a joint of the end portion of the center conductor and the contact with the insulation housing.

An example electrical connector disclosed herein may include: an end portion of a center conductor exposed at an end portion of a coaxial cable having the center conductor; a conductive contact joined to the end portion of the center conductor by solid-phase bonding; and an insulation housing that accommodates the contact. In the electrical connector, the insulation housing may have a contact support that sandwiches the contact with the end portion of the center conductor.

DETAILED DESCRIPTION

Figure 1:
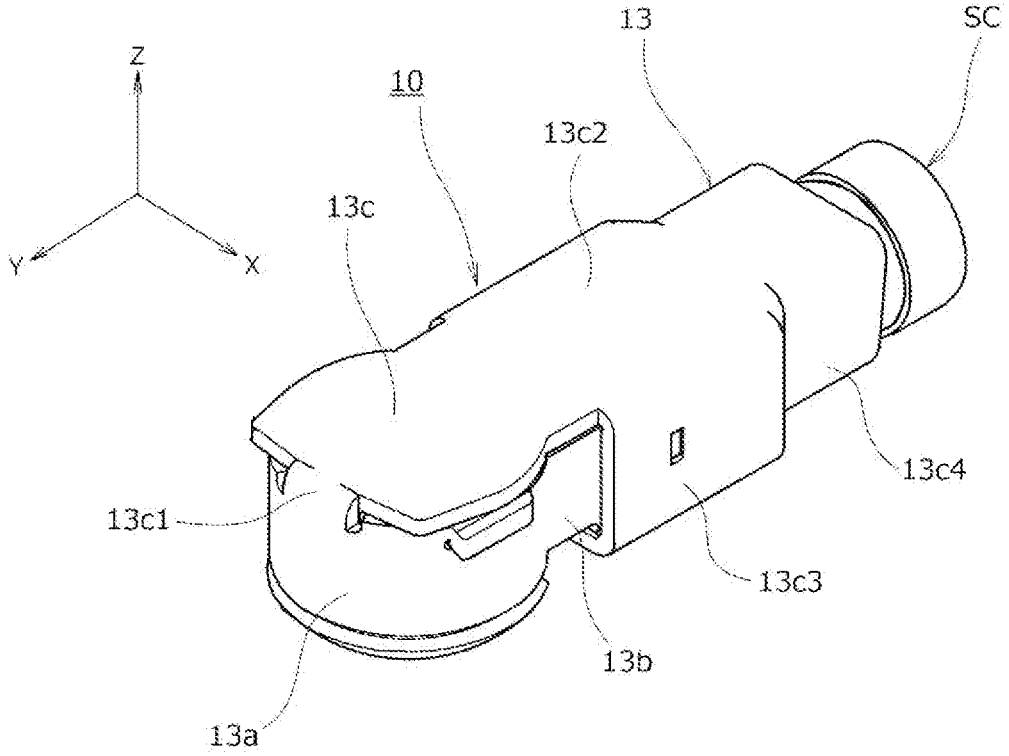
FIG. 1 is an explanatory external perspective view illustrating a state in which a coaxial cable is connected to an example electrical connector (a plug connector) according to an example, as viewed from a front upper side.

In the following description, with reference to the drawings, the same reference numbers are assigned to the same components or to similar components having the same function, and overlapping description is omitted.

As described in BACKGROUND section, in a case in which the jig such as the horn for applying ultrasonic vibration or the anvil is used while inserted into the housing, there is a restriction that a space for inserting the jig such as the horn or the anvil should be taken into consideration when designing the housing, and thus the degree of freedom in design is reduced, and it may be difficult to reduce the size, for example. Further, when the jig such as the horn for applying ultrasonic vibration or the anvil is designed, there is a restriction based on a structure of the housing. For example, it is conceivable that design to obtain an optimum resonance point when applying ultrasonic vibration is not possible, and thus sufficient joining strength between the center conductor of the coaxial cable and the contact cannot be obtained.

In recent years, electrical connectors have been required to have a significantly smaller size in addition to a higher frequency signal, and therefore joining strength between the center conductor of the coaxial cable and the contact has had a tendency to decrease. Therefore, there is a need for a structure in which the center conductor of the coaxial cable is joined to the contact with high strength and thus electrical connection stability can be improved while the size of the electrical connector is reduced.

Example electrical connectors and methods of manufacturing an electrical connector are disclosed herein, in which joining strength may be improved while the size may be reduced by increasing the degree of freedom in designing a housing and a jig such as a horn or an anvil, and an electrical connector may be provided in which a center conductor of a coaxial cable can be joined to a contact with high strength while the size can be reduced.

In some example methods of manufacturing an electrical connector, a signal transmission contact formed of a conductive member is attached to a housing formed of an insulation member, and a center conductor of a coaxial cable is connected to the contact, includes a joining operation with ultrasonic vibration of applying ultrasonic vibration in a state in which the center conductor of the coaxial cable is brought into contact with the contact before being attached to the housing to form a contact assembly in which the center conductor of the coaxial cable is joined to the contact; and an assembling operation of attaching the contact of the contact assembly formed in the joining operation with ultrasonic vibration to the housing.

Additionally, a jig such as a horn for applying ultrasonic vibration or an anvil may be used in a place independent of the housing, and thus the jig is not inserted into the housing when used, unlike the related art. Therefore, the restriction in designing the housing decreases to that extent, and the degree of freedom in design increases, so that the size of the electrical connector may be reduced. Further, since the jig such as the horn for applying ultrasonic vibration or the anvil is also not restricted by the structure of the housing, the horn and the anvil may be designed so as to obtain an optimum resonance point, and ultrasonic vibration can be efficiently applied, so that sufficient joining strength between the center conductor of the coaxial cable and the contact can be easily obtained.

In the assembling operation, the contact of the contact assembly may be attached to the housing by press-fitting.

In the assembling operation, the housing may be molded by insert molding after the contact assembly is set in a mold.

According to such a method of manufacturing an electrical connector, a connection portion between the contact and the center conductor of the coaxial cable is held by the housing, so that an electrical connection state of the electrical connector is stabilized and strength thereof is improved.

In the joining operation with ultrasonic vibration, a tip end surface of a horn may be brought into contact with the center conductor of the coaxial cable and an anvil may be brought into contact with the contact, ultrasonic vibration may be applied in a state in which the contact and the center conductor of the coaxial cable are interposed between the horn and the anvil, and a recess for accommodating the center conductor of the coaxial cable may be provided in the tip end surface of the horn.

The recess provided in the horn may be formed as a groove-shaped portion extending in an extending direction of the center conductor of the coaxial cable, the groove-shaped portion may have a groove opening having a groove width corresponding to the center conductor of the coaxial cable, and a pair of groove side wall portions extending in a state in which they face each other from the groove opening toward a groove bottom portion that is a bottom of the groove-shaped portion, and in the pair of groove side wall portions, an interval between the pair of groove side wall portions may become narrower from the groove opening toward the groove bottom portion.

In some examples, ultrasonic vibration is efficiently transmitted to the center conductor of the coaxial cable and the contact via the groove side wall portion constituted by an inclined surface provided in the horn.

An electrical connector may include a housing formed of an insulation member; and a contact formed of a conductive member to which a terminal portion of a center conductor of a coaxial cable is connected with application of ultrasonic vibration, and which is attached to the housing, wherein, in the terminal portion of the center conductor of the coaxial cable, a cross section in a direction orthogonal to an extending direction of the center conductor is a shape having at least three sides, wherein one side of the three sides constituting a cross-sectional shape of the terminal portion of the center conductor is connected to the contact, and wherein, in a pair of other sides extending from both ends of the one side, an interval between the pair of other sides becomes narrower away from the contact.

In some examples, when the center conductor of the coaxial cable and the contact are joined, ultrasonic vibration is efficiently applied via the jig such as the horn or the anvil, and thus higher joining strength between the center conductor and the contact may be obtained.

An electrical connector may include a housing formed of an insulation member; and a contact formed of a conductive member to which a terminal portion of a center conductor of a coaxial cable in an extending direction thereof is connected with application of ultrasonic vibration, and which is attached to the housing, wherein the terminal portion of the center conductor of the coaxial cable has a first surface portion and a second surface portion which face each other in a direction orthogonal to the extending direction of the center conductor, wherein one of the first surface portion and the second surface portion is connected to the contact, wherein the first surface portion includes a single or a plurality of flat surfaces extending in the extending direction, and wherein the second surface portion includes a single or a plurality of flat surfaces extending in the extending direction, or a single or a plurality of curved surfaces extending in the extending direction.

When the center conductor of the coaxial cable and the contact are joined, ultrasonic vibration is efficiently applied via the jig such as the horn or the anvil, and thus sufficient joining strength between the center conductor and the contact may be obtained.

Each of the plurality of flat surfaces constituting the first surface portion may have one end edge and another end edge extending in the extending direction, and the one edges of each of the flat surfaces may be directly connected to each other or be indirectly connected to each other via another surface portion.

As described above, the plurality of flat surfaces constituting the first surface portion of the center conductor of the coaxial cable are connected to the contact, and thus a contact area between the center conductor of the coaxial cable and the contact increases, so that sufficient joining strength may be obtained when performing the joining with ultrasonic vibration.

The first surface portion may be constituted by two flat surfaces extending in a state in which they are inclined in a direction intersecting with the extending direction, each of the two flat surfaces constituting the first surface portion may have one end edge and another end edge extending in the extending direction, and the one edges of each of the two flat surfaces may be directly connected to each other.

Each of the plurality of flat surfaces or curved surfaces constituting the second surface portion may have one end edge and another end edge extending in the extending direction, and the one edges of each of the flat surfaces or curved surfaces may be directly connected to each other or be indirectly connected to each other via another surface portion.

Both outermost end edges of the first surface portion in a direction orthogonal to the extending direction and both outermost end edges of the second surface portion in a direction orthogonal to the extending direction may be directly connected to each other or be indirectly connected to each other via another surface portion.

In the center conductor of the coaxial cable, a maximum dimension H in a direction in which the first surface portion and the second surface portion face each other may be smaller than a maximum dimension W in a direction orthogonal to the direction in which the first surface portion and the second surface portion face each other ($H<W$).

The contact may have a connection portion to which the center conductor of the coaxial cable is connected, and the connection portion may have a groove portion extending in the extending direction.

In the groove portion of the contact, a cross section in a direction orthogonal to the extending direction may have any one of a V shape, an arc shape, or a polygonal shape.

The contact may have gold plating at a portion to which the center conductor of the coaxial cable is connected, and the terminal portion of the center conductor of the coaxial cable may have silver plating at a portion to be connected to the gold plating of the contact.

In some examples electrical connectors, greater joining strength may therefore be obtained, and variation in joint strength is reduced.

A connection portion between the contact and the center conductor of the coaxial cable may be embedded in the housing.

A shield shell formed of a conductive member which is disposed to cover an outer surface of the housing may be attached to the housing and the shield shell may be electrically connected to an outer conductor of the coaxial cable, the contact may be an inner conductor contact disposed in a region covered with the shield shell, and a wire connection portion that is an electrical connection portion between the inner conductor contact and the terminal portion of the center conductor of the coaxial cable may be disposed in the region of the shield shell.

As described above, the joining strength may be improved while reducing the size of the electrical connector.

[Structure of Electrical Connector]

Figure 2:
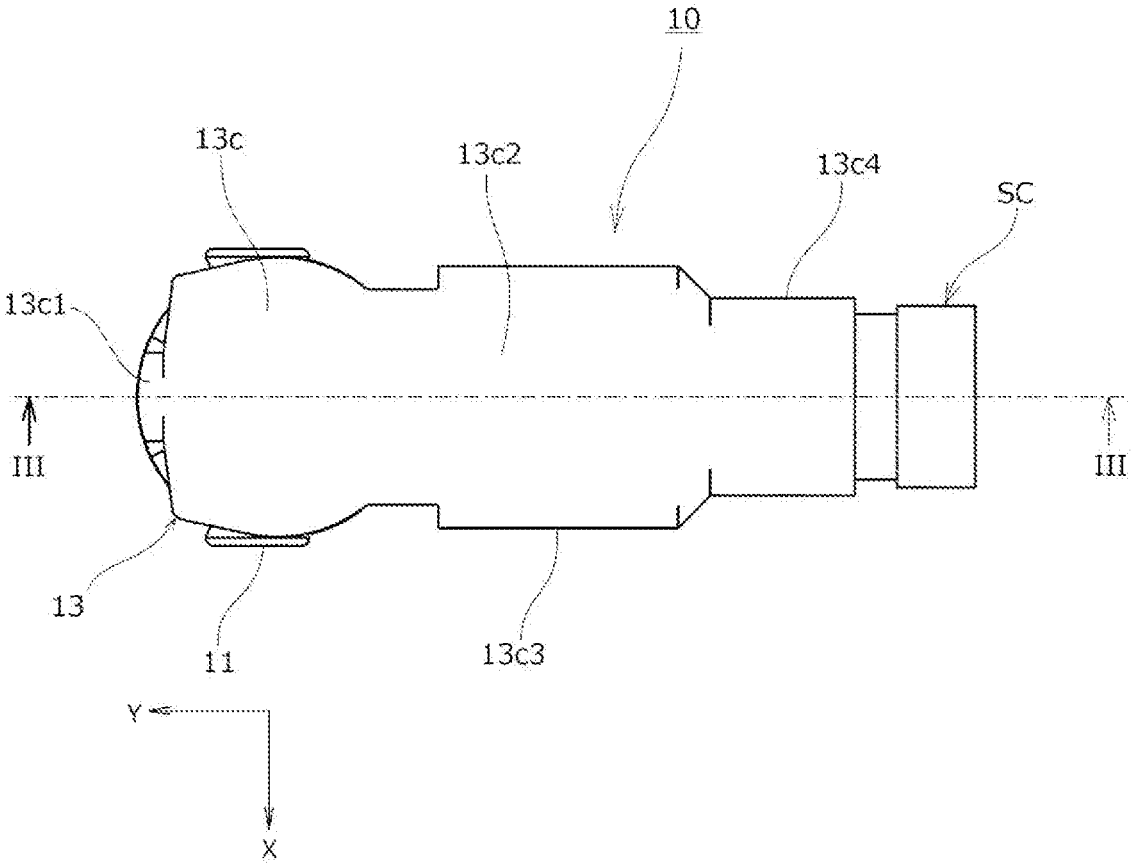
FIG. 2 is an explanatory plan view of the electrical connector (the plug connector) shown in FIG. 1.
Figure 3:
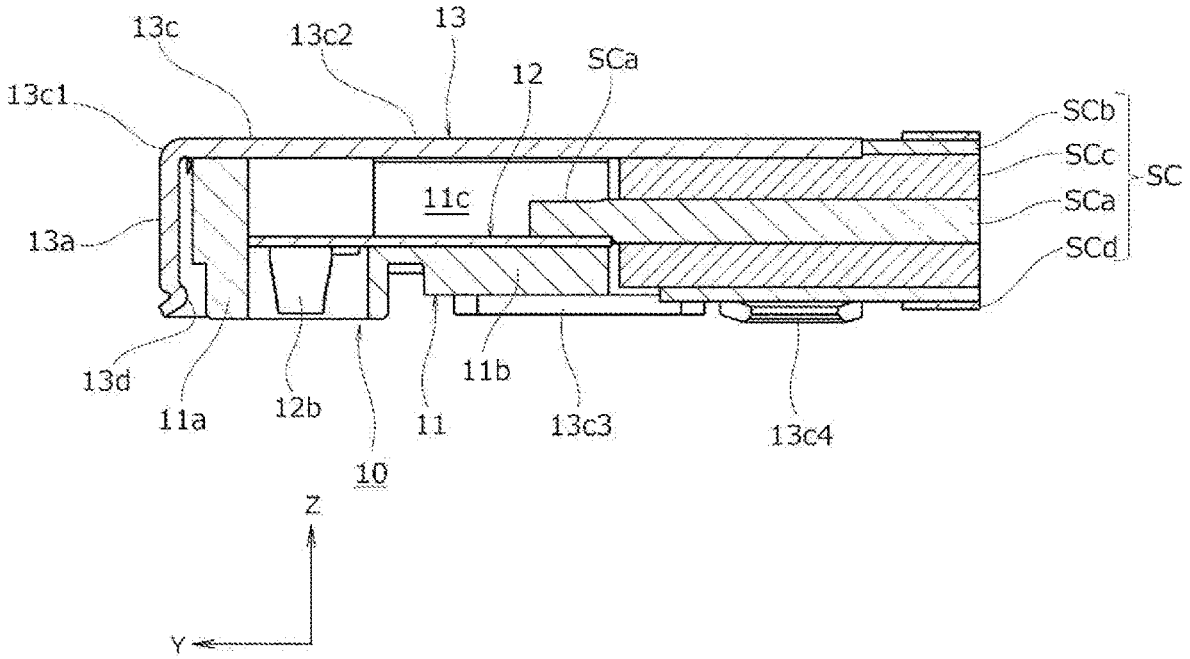
FIG. 3 is an explanatory vertical cross-sectional view along line III-III in FIG. 2.

First, a terminal portion of a coaxial cable SC is connected to a plug connector 10 which constitutes an electrical connector according to an example shown in FIGS. 1 to 3, and the plug connector 10 to which the coaxial cable SC is connected is fitted to a mating electrical connector constituted by a receptacle connector or the like mounted on a main surface of a predetermined wiring board to be inserted from above or is removed from the fitted state. The work of fitting and removing the plug connector 10 to and from the mating electrical connector (the receptacle connector or the like) is performed in a direction substantially orthogonal to a main surface of the wiring board.

In some examples, as shown in FIG. 1, a fitting portion disposed in a front portion of the above-described plug connector 10 is formed to have a substantially cylindrical shape, and the terminal portion of the coaxial cable SC is connected to the fitting portion having a substantially cylindrical shape from one side (a rear side) outward in a radial direction. After the fitting portion of the above-described plug connector 10 is disposed above a fitted portion of the mating electrical connector (the receptacle connector or the like) for fitting in a facing state, the entire plug connector 10 is lowered in a direction substantially orthogonal to an outer surface (a main surface) of a printed wiring board, and thus a lower end portion of the fitting portion of the plug connector 10 is fitted to an upper end portion of the fitted portion of the mating electrical connector.

As described above, the plug connector 10 is inserted into the mating electrical connector (the receptacle connector or the like) for fitting from above to be fitted thereto, and thus the coaxial cable SC is connected to a conductive path of a wiring pattern on the wiring board via the plug connector 10 and the mating electrical connector (the receptacle connector or the like), so that a signal is transmitted.

Here, a direction in which the plug connector 10 is inserted into the above-described mating electrical connector (the receptacle connector or the like) is referred to as a "downward direction" (a negative direction of a Z axis in the drawing), while a direction in which the plug connector is pulled out is referred to as an "upward direction" (a positive direction of the Z axis in the drawing). Further, the coaxial cable SC is set to extend in a "horizontal direction" parallel to the surface of the wiring board from a "rear surface" of the plug connector 10, and a direction in which the coaxial cable SC extends from the plug connector 10 is referred to as a "rearward direction" (a negative direction of a Y axis in the drawing) and a direction opposite to this is referred to as a "forward direction" (a positive direction of the Y axis in the drawing). Furthermore, a direction that is orthogonal to both a "vertical direction" (a positive-negative direction of the Z axis in the drawing) and a "front-rear direction" (a positive-negative direction of the Y axis in the drawing) is referred to as a "left-right direction" (a positive-negative direction of an X axis in the drawing).

[Coaxial Cable]

Figure 6:
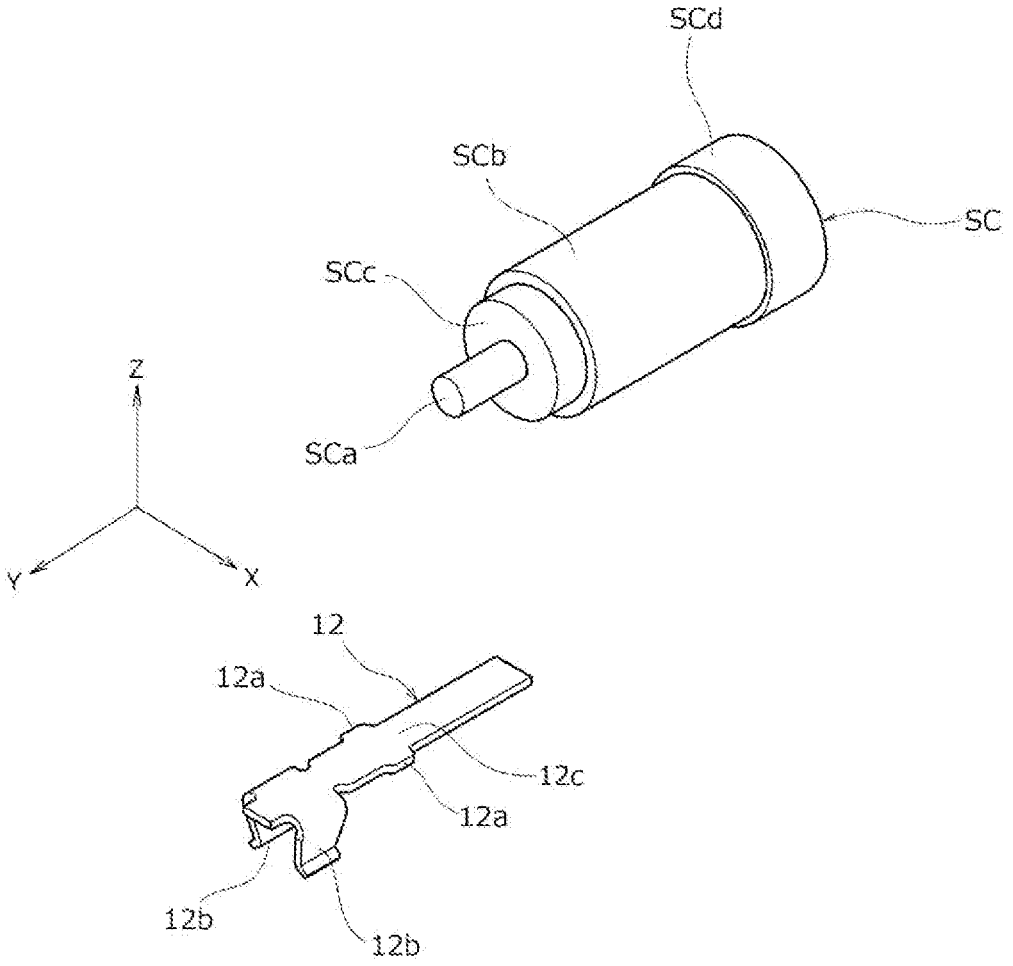
FIG. 6 is an explanatory external perspective view showing a state in which a terminal portion of the coaxial cable is disposed above an inner conductor contact (a signal contact member) such that they face each other, as viewed from the front upper side.

As shown in FIG. 6, the coaxial cable SC has a center conductor (a signal wire) SCa formed of a conducting wire in a center portion of the coaxial cable SC, and an outer conductor (a shield wire) SCb is coaxially laminated outside the center conductor (the signal wire) SCa in the radial direction via an annular dielectric SCc. Further, an outer surface of the outer conductor (the shield wire) SCb is covered with an outer periphery covering material SCd.

Figure 15:
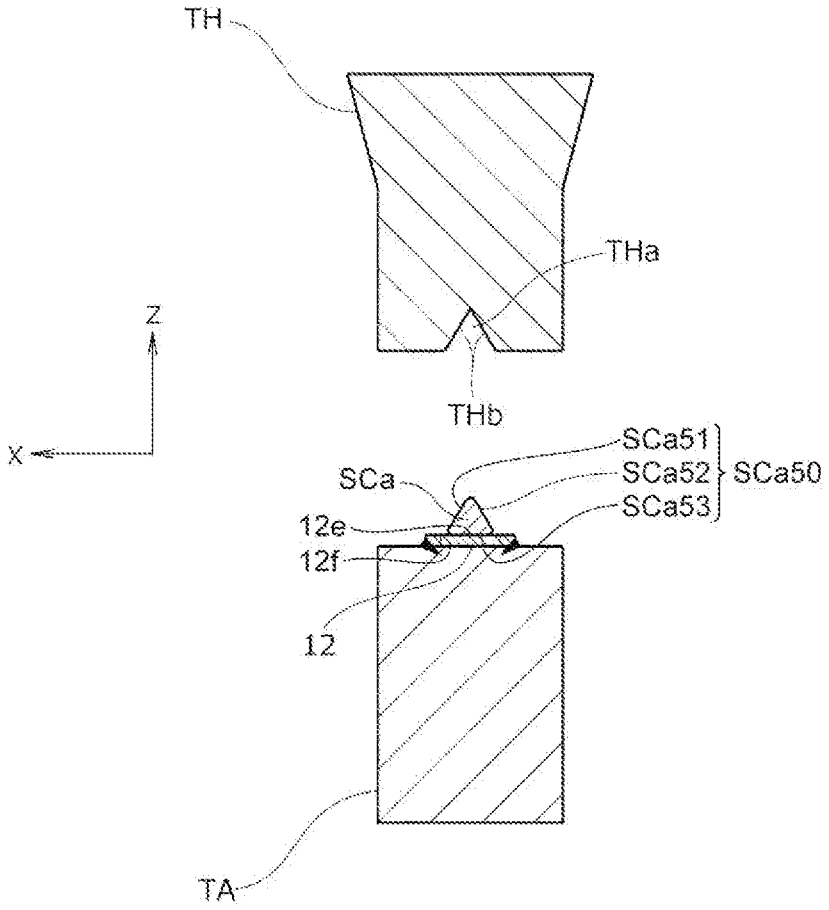
FIG. 15 is an explanatory cross-sectional view of the horn raised from the state of FIG. 14.

In the terminal portion of the coaxial cable SC having such a configuration, the outer periphery covering material SCd is peeled off, so that the outer conductor (the shield wire) SCb is exposed to the outside, and the outer conductor (the shield wire) SCb and the dielectric SCc are peeled off, so that the center conductor (the signal wire) SCa is exposed to the outside. The terminal portion of the center conductor SCa disposed along a center axis of the coaxial cable SC is joined to an inner conductor contact (a signal contact member, a conductive contact or a contact) 12 to be attached to an insulation housing 11, and is electrically connected thereto to form a signal circuit. The contact 12 may be joined to the end portion of the center conductor SCa by solid-phase bonding. The contact 12 may be joined to the end portion of the center conductor SCa by applying ultrasonic vibration for the solid-phase bonding. The center conductor SCa may have a circular cross section in the coaxial cable SC and the end portion of the center conductor SCa may be joined to the contact 12 in a plastically deformed state to have a non-circular cross section. As shown in FIG. 15, the contact 12 may have a joint surface 12*e*. A formed joint surface SCa53 along the joint surface 12*e* may be formed on a part of an outer peripheral surface SCa50 of the end portion of the center conductor SCa. The formed joint surface SCa53 may be joined to the joint surface 12*e*. Formed outer surfaces SCa51 and SCa52 including a flat part may be formed on a back surface of the formed joint surface SCa53 of the outer peripheral surface SCa50 of the end portion of the center conductor SCa.

The center conductor SCa of the coaxial cable SC may be formed of a linear conductive member whose main component is a copper component, and an outer surface of the center conductor SCa is silver-plated. As shown in FIG. 6, in the terminal portion of the silver-plated center conductor SCa, that is, a portion exposed to the outside by peeling, a cross section in a direction orthogonal to an extending direction of the center conductor SCa has a "polygonal shape" by being joined to the inner conductor contact (the signal contact member) 12 to be attached to the insulation housing 11 by a manufacturing method that will be described later. A substantially triangular shape is employed as an example "polygonal shape" in some examples, and one side (a lower side) of the three sides for forming the substantially triangular shape is joined to a flat surface of a flat plate portion 12*c* of the above-described inner conductor contact (the signal contact member) 12 which is closer to the "rear side."

Further, a pair of other sides extend obliquely upward from both ends of one side of the "substantially triangular shape" that constitutes a cross-sectional shape of the terminal portion of the center conductor SCa of the coaxial cable SC, for example, one side (the lower side) joined to the inner conductor contact (the signal contact member) 12, while a distance between the pair of other sides is continuously reduced in the "upward direction" away from the inner conductor contact (the signal contact member) 12.

The cross section of the center conductor (signal wire) SCa of the above-described coaxial cable SC in a direction orthogonal to the extending direction (the positive-negative direction of the Y axis in the drawing) may have any shape having at least three sides, and a side of a portion interposed by two sides of the three sides forming the cross-sectional shape may be a linear line or a curved line, or may have an angular shape.

Figure 16:
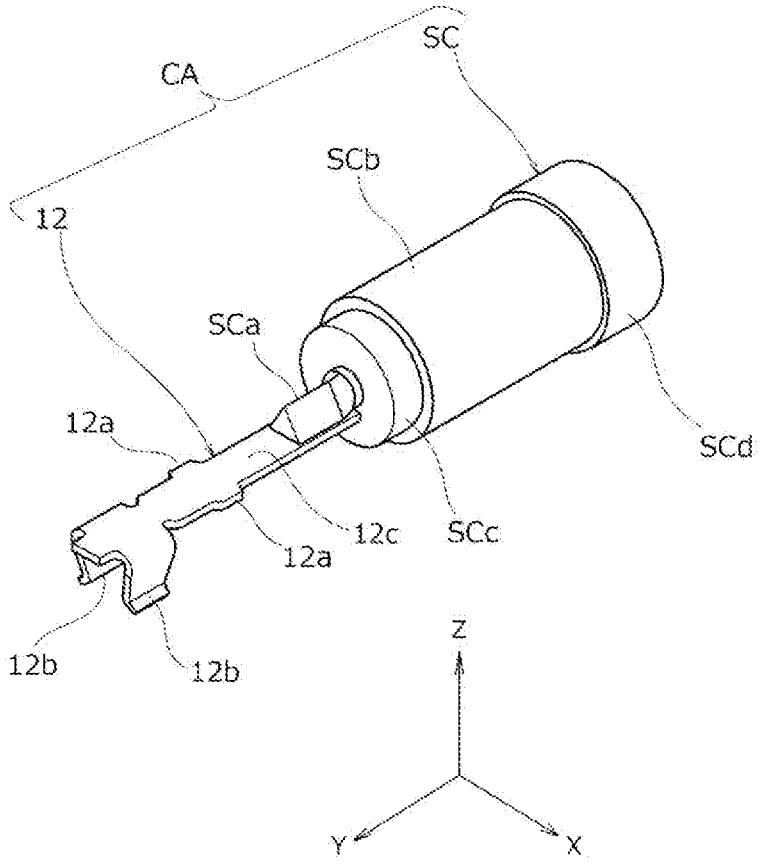
FIG. 16 is an explanatory external perspective view showing a state in which the center conductor (the signal wire) of the coaxial cable is joined to a rear end portion of the inner conductor contact (the signal contact member), as viewed from the front upper side.
Figure 17:
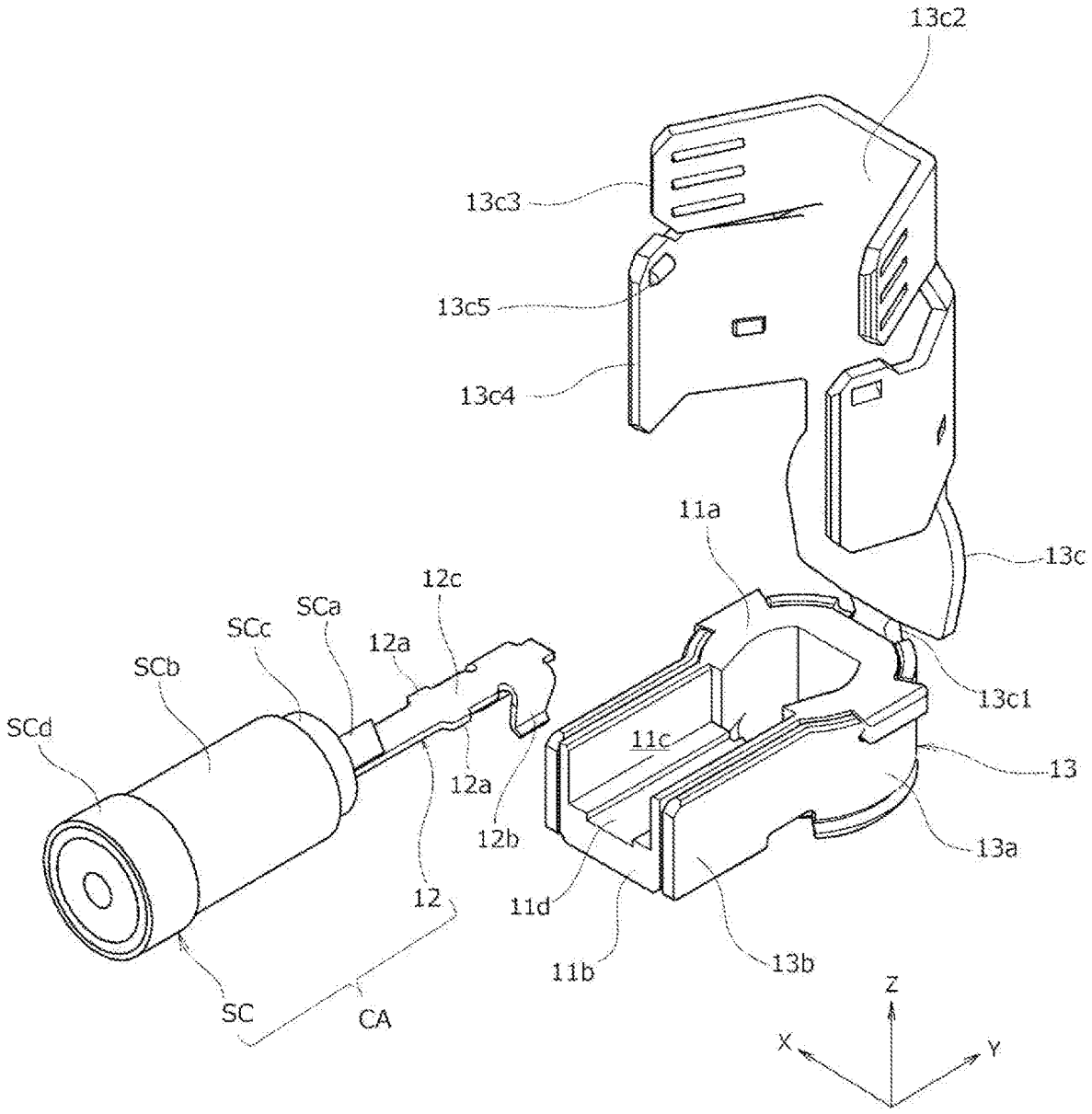
FIG. 17 is an explanatory external perspective view showing a state in which a contact assembly obtained by joining the center conductor (the signal wire) of the coaxial cable to of the inner conductor contact (the signal contact member) is disposed above the electrical connector (the plug connector) in an initial state such that they face each other, as viewed from the back upper side.

In some examples, the cross-sectional shape of the center conductor (the signal wire) SCa of the coaxial cable SC, for example, the cross-sectional shape in a direction orthogonal to the extending direction (the positive-negative direction of the Y axis in the drawing) may be a "substantially triangular shape." As shown in FIGS. 16 and 17, among three flat surfaces having the three sides of the center conductor (the signal wire) SCa, a lower surface to be connected to the flat plate portion 12*c* of the inner conductor contact (the signal contact member) 12 is a "first surface portion." The "first surface portion" may be constituted by a single flat surface that extends in the extending direction (the positive-negative direction of the Y axis in the drawing) of the center conductor (the signal wire) SCa, and a "second surface portion" disposed above the "first surface portion" such that they face each other is configured to have two flat surfaces extending in the extending direction (the positive-negative direction of the Y axis in the drawing) of the center conductor (the signal wire) SCa.

Then, each of the three flat surfaces constituting these "first surface portion" and "second surface portion" has two end edges constituted by one end edge and another end edge extending in the extending direction (the positive-negative direction of the Y axis in the drawing) of the coaxial cable SC, and the one end edges of each of the flat surfaces are directly connected to each other.

The center conductor SCa of the coaxial cable SC extending initially in a circular cross-sectional shape as shown in FIG. 6 is joined to the inner conductor contact (the signal contact member) 12 to be attached to the insulation housing 11 from above as shown in FIGS. 16 and 17, and as a result, the center conductor SCa of the coaxial cable SC is made to have the "substantially triangular" cross-sectional shape. For this, a method using ultrasonic vibration is employed, and a joining method thereof, a method of attaching the inner conductor contact (the signal contact member) 12 to the insulation housing 11, and the like will be described later in detail.

[Insulation Housing]

The insulation housing 11 accommodates the inner conductor contact 12. The insulation housing 11 may have a contact support that sandwiches the inner conductor contact 12 with the end portion of the center conductor SCa. The insulation housing 11 may be formed of a base frame-shaped member formed of an insulation material. The inner conductor contact (the signal contact member) 12 and a shield shell 13 serving as a ground contact member are attached to the insulation housing 11 in an insulated state. A structure for attaching these elements will be described later, but the insulation housing 11 may have a structure in which a jig such as a horn for applying ultrasonic vibration or an anvil is not inserted into the insulation housing, so that the degree of freedom in design is increased. An outer peripheral portion of the insulation housing 11 is covered with the shield shell 13 formed of a thin plate-shaped metal member. The outer conductor SCb surrounding the center conductor SCa of the above-described coaxial cable SC is brought into contact with the shield shell 13 so that they are electrically connected to each other, and thus the shield shell 13 functions as a conductive member for ground, so that a ground circuit is formed.

Figure 4:
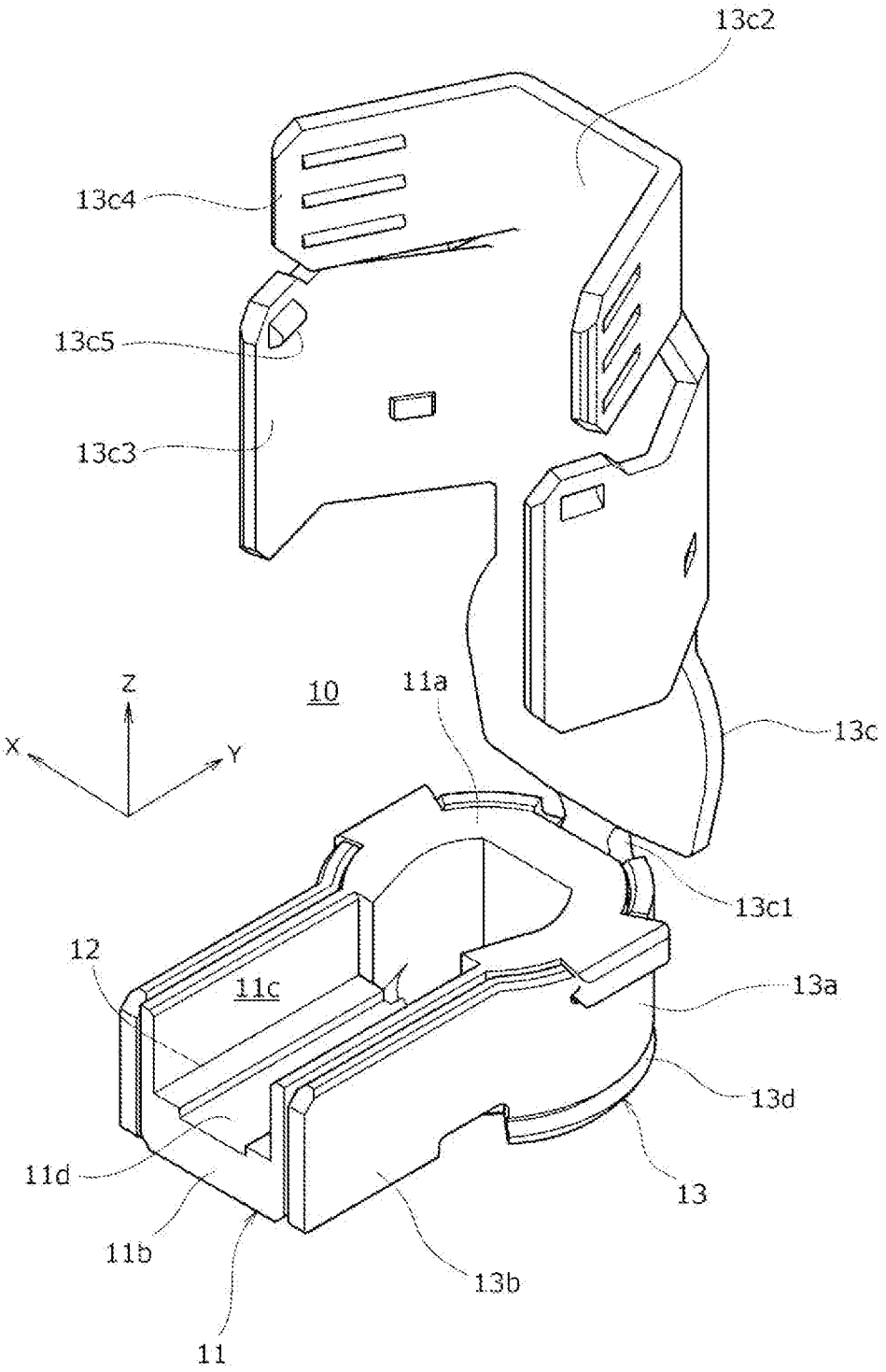
FIG. 4 is an explanatory external perspective view illustrating an initial state of the electrical connector (the plug connector) shown in FIGS. 1 to 3 before a contact is attached thereto, as viewed from a back upper side.
Figure 5:
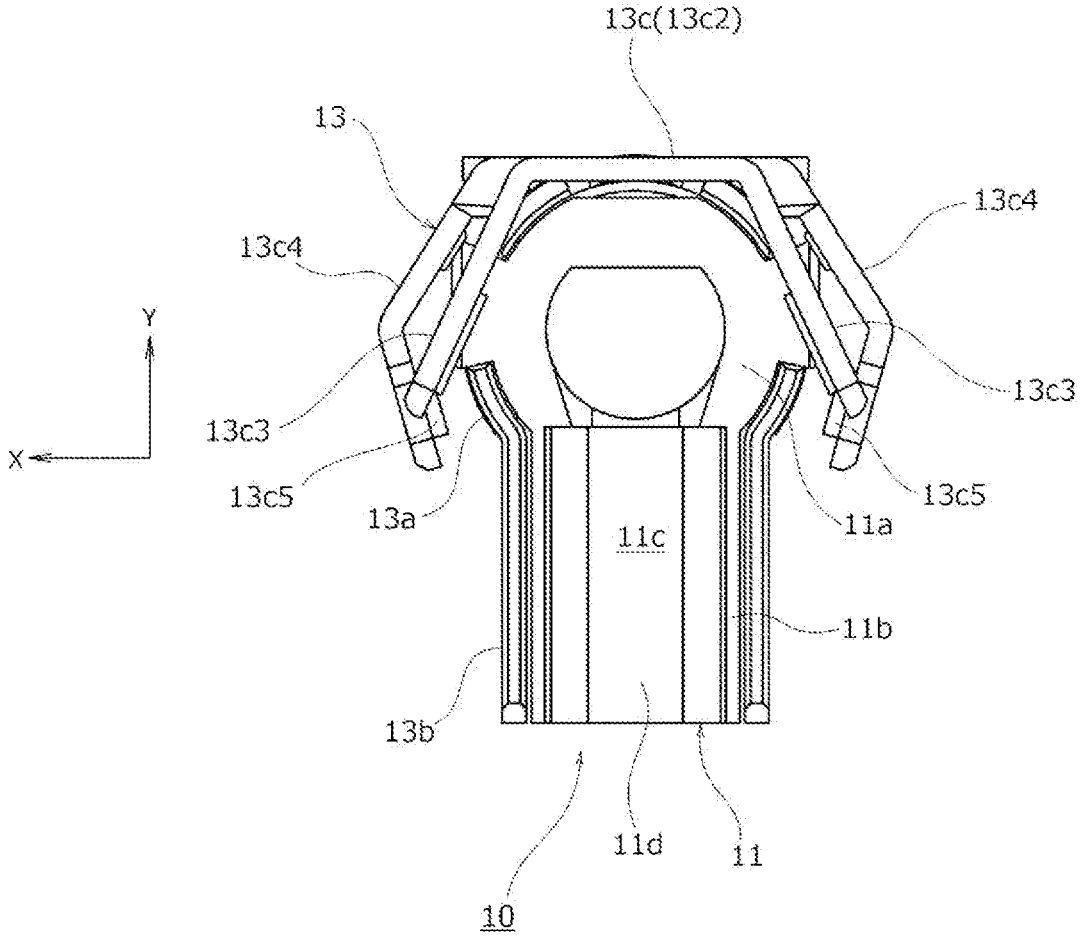
FIG. 5 is an explanatory plan view of the electrical connector (the plug connector) shown in FIG. 4.

As shown in FIGS. 4 and 5, the above-described insulation housing 11 has a substantially cylindrical fitting main body portion 11*a*, and a wire connection support portion 11*b* projects substantially horizontally toward the "rear side" (in the negative direction of the Y axis in the drawing) from a rear end portion (a portion in the negative direction of the Y axis in the drawing) of the fitting main body portion 11*a*. A contact accommodating space (or a cavity) 11*c* for accommodating the above-described inner conductor contact (the signal contact member) 12 is formed in the fitting main body portion 11*a* and the wire connection support portion 11*b* in a state in which it opens toward an "upper side" (in the positive direction of the Z axis in the drawing).

In some examples, first, the fitting main body portion 11*a* is formed of a substantially cylindrical body in a hollow shape, and a hollow portion penetratingly formed in a center portion of the fitting main body portion 11*a* in the radial direction constitutes a part of the contact accommodating space 11*c*. Further, the wire connection support portion 11*b* (or the contact support) is formed in a gutter shape having a substantially rectangular cross section that is open toward the "upper side" (in the positive direction of the Z axis in the drawing), and an inner space portion of the wire connection support portion 11*b* constitutes a main portion of the above-described contact accommodating space 11*c*. As described above, the contact accommodating space 11*c* is configured of a space portion that communicates from the wire connection support portion 11*b* to the fitting main body portion 11*a* in a gutter shape.

The inner conductor contact (the signal contact member) 12 that extends substantially horizontally is attached to a bottom wall surface 11*d* of inner wall surfaces of the wire connection support portion 11*b* and the fitting main body portion 11*a* that form the contact accommodating space lie by being press-fitted.

[Signal Contact Member]

The inner conductor contact (the signal contact member) 12 attached to the insulation housing 11 by the press-fitting as described above functions as a connection terminal formed of a conductive member. As shown in FIG. 6, the flat plate portion 12*c* is configured of a strip shaped member that extends in an elongated shape in the "front-rear direction" (the positive-negative direction of the Y axis in the drawing).

Figure 18:
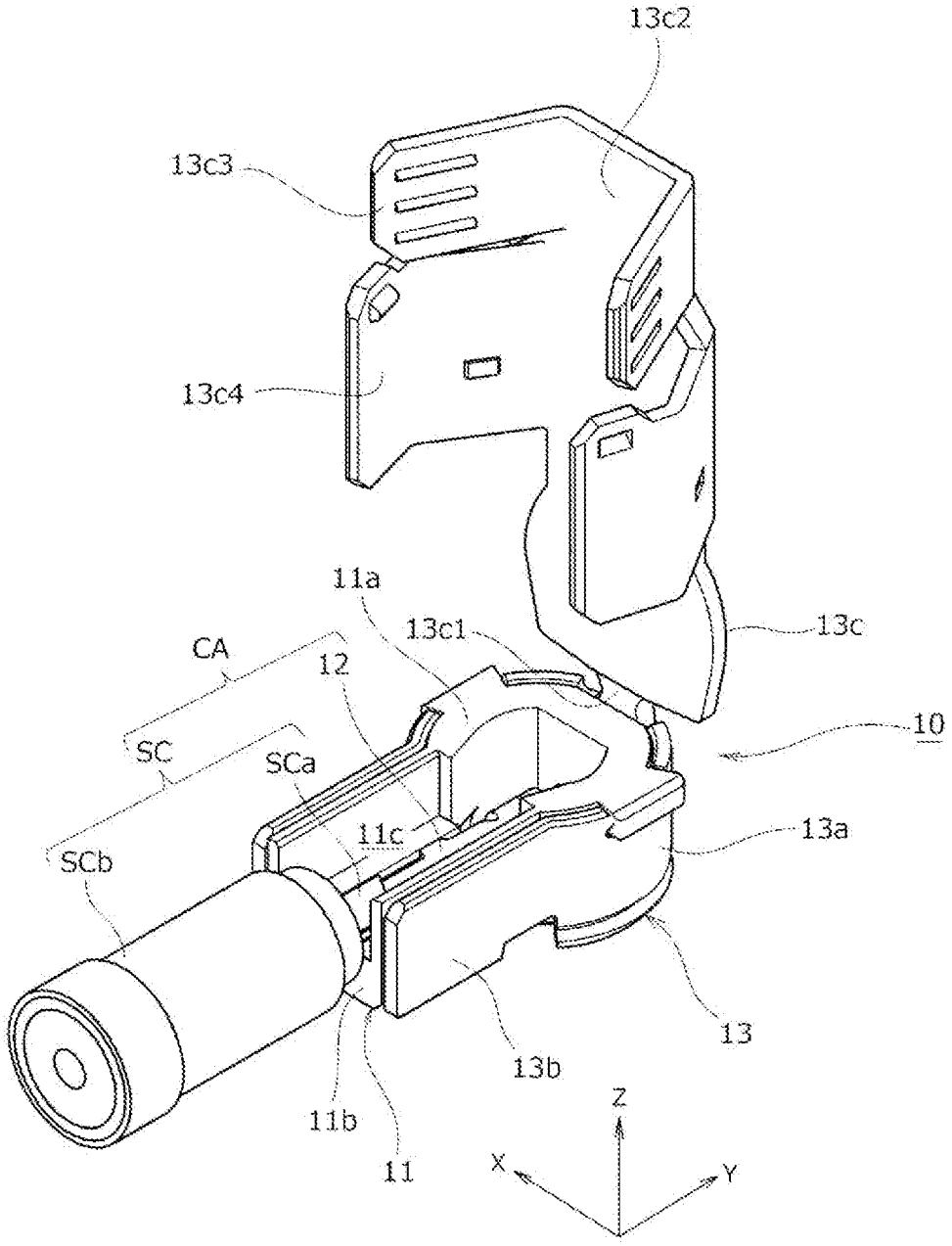
FIG. 18 is an explanatory external perspective view showing a state in which, from the state shown in FIG. 17, the contact assembly is inserted into a contact accommodating space of the electrical connector (the plug connector) in an initial state, and the inner conductor contact (the signal contact member) is attached to a housing by the press-fitting, as viewed from the back upper side.
Figure 19:
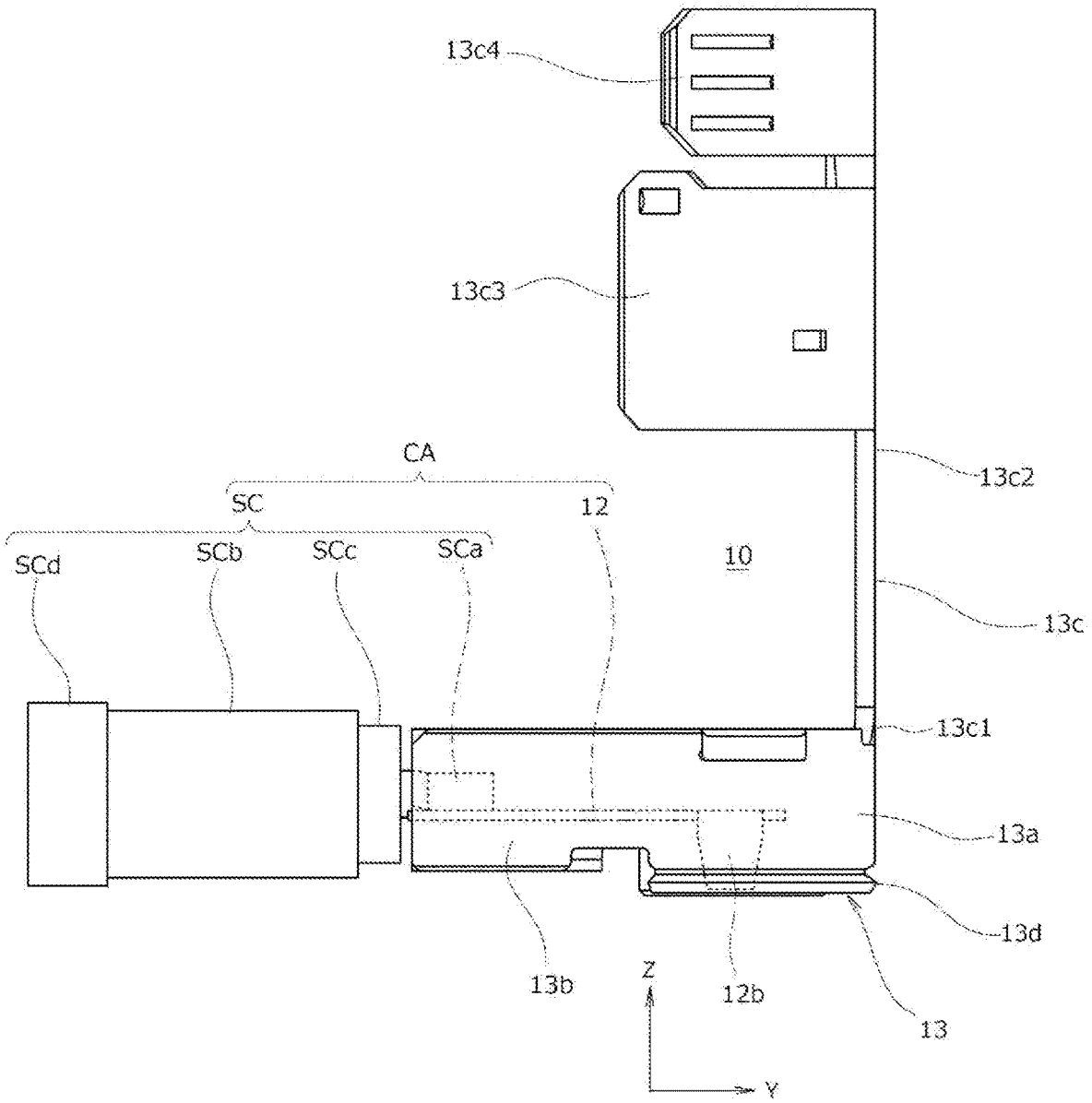
FIG. 19 is an explanatory side view showing a state in which the inner conductor contact (the signal contact member) of the contact assembly is attached to the electrical connector (the plug connector) shown in FIG. 18.

A pair of locking pieces 12*a* and 12*a* to be press-fitted into the insulation housing 11 are formed at substantially a center portion of the flat plate portion 12*c* of the inner conductor contact (the signal contact member) 12 in the extending direction (the front-rear direction represented as the positive-negative direction of the Y axis in the drawing). These locking pieces 12*a* and 12*a* project outward from both end edge portions of the flat plate portion 12*c* in the "left-right direction" (a plate width direction represented as the positive-negative direction of the X axis in the drawing) in a plate shape. Both of the locking pieces 12*a* and 12*a* are engaged with inner wall surfaces of the wire connection support portion 11*b* of the above-described insulation housing 11 such that they bite the inner wall surface, and thus the entire inner conductor contact (the signal contact member) 12 is maintained in a fixed state (the fixed state is shown in FIGS. 18 and 19).

The terminal portion of the center conductor SCa of the above-described coaxial cable SC is joined to a flat portion of the flat plate portion 12*c* of such an inner conductor contact (the signal contact member) 12 which is closer to the "rear side" (in the negative direction of the Y axis in the drawing) by a method that will be described later in a state in which the terminal portion is placed from the "upper side" (in the positive direction of the Z axis in the drawing). As shown in FIG. 6, in a portion of the flat plate portion 12*c* of the inner conductor contact (the signal contact member) 12 which is closer to a "front side" (in the positive direction of the Y axis in the drawing), a pair of elastic spring portions 12*b* and 12*b* integrally extend toward the "lower side" (in the negative direction of Z axis in the drawing) from both end edge portions in the plate width direction that is the "left-right direction" (the positive-negative direction of the X axis in the drawing). Both elastic spring portions 12*b* and 12*b* are inserted into a through-hole provided in the fitting main body portion 11*a* of the insulation housing 11 as shown in FIG. 3 showing a state after completion. The elastic spring portions 12*b* and 12*b* are disposed in a state in which they face each other in the "left-right direction" (the positive-negative direction of the X axis in the drawing) with an interval therebetween in the through-hole of the fitting main body portion 11*a*.

When a lower portion of the fitting main body portion 11*a* of the insulation housing 11 is inserted into the mating electrical connector (the receptacle connector or the like) for fitting, a signal conductive contact having a pin shape or the like provided in the mating electrical connector (the receptacle connector or the like) for fitting is inserted into a portion between both elastic spring portions 12*b* and 12*b* described above in a state in which it is brought into contact therewith, and thus an electrically connected state is achieved, so that a signal transmission circuit is formed.

The flat plate portion 12*c* may extend to be flat from a front end portion at which the pair of elastic spring portions 12*b* and 12*b* integrally extend to the rear end portion (an end portion in the negative direction of the Y axis in the drawing), but the flat plate portion may be configured to extend to have a step portion from the elastic spring portions 12*b* and 12*b*.

[Shield Shell]

An outer peripheral portion of the insulation housing 11 is covered with the shield shell 13 formed of a thin plate-shaped metal member. The outer conductor SCb surrounding the center conductor SCa of the above-described coaxial cable SC is brought into contact with the shield shell 13 to be an electrical connection state, and thus the shield shell 13 functions as a conductive member for ground, so that a ground circuit is formed.

The shield shell 13 formed of a thin plate-shaped metal member which covers an outer surface of the insulation housing 11 as described above includes an outer conductor shell 13*a* and a shell projection 13*b* that partially cover the fitting main body portion 11*a* and the wire connection support portion 11*b* of the insulation housing 11, as shown in FIGS. 4 and 5. The outer conductor shell 13*a* constitutes a substantially hollow cylindrical ground contact member that annularly covers mainly the fitting main body portion 11*a* of the insulation housing 11 from the outside in the radial direction.

The outer conductor shell (the ground contact member) 13*a* is disposed to surround the periphery of the above-described inner conductor contact (the signal contact member) 12 from the outside, and a lower portion of the outer conductor shell (the ground contact member) 13*a* has a substantially cylindrical shape that is fitted onto an outer portion of the mating electrical connector (the receptacle connector or the like) in the radial direction. A fitting engagement portion 13*d* constituted by an annular groove provided in the lower portion of the outer conductor shell (the ground contact member) 13*a* is electrically connected to a connection locking portion provided in the mating electrical connector (the receptacle connector or the like) for fitting in an elastic fitting relationship.

Further, a shell lid portion 13*c* that covers the fitting main body portion 11*a* and the wire connection support portion 11*b* of the above-described insulation housing 11 from the "upper side" (in the positive direction of the Z axis in the drawing) is connected to an annular opening portion on the "upper side" (in the positive direction of the Z axis in the drawing) forming an upper end edge of the outer conductor shell 13*a* to be openable and closable. That is, the shell lid portion 13*c* of the shield shell 13 is connected to an end edge portion of the outer conductor shell 13*a* on the "front side" (in the positive direction of the Y axis in the drawing) to be openable and closable via a connection member 13*c*1 formed of a narrow plate-shaped member. In an initial state before the shell lid portion is connected to the coaxial cable SC, as shown in FIGS. 4 and 5, the shell lid portion becomes an open state in which the shell lid portion rises toward the "upper side" (in the positive direction of the Z axis in the drawing).

In the open state (the initial state) of the shield shell 13 shown in FIGS. 4 and 5, the inner conductor contact (a member that constitutes a contact assembly CA (see FIG. 16), which will be described in detail later) after the center conductor SCa of the coaxial cable SC is joined is inserted into the contact accommodating space 11*c* provided in the insulation housing 11 to be placed from the "upper side" (in the positive direction of the Z axis in the drawing), and then is press-fitted, so that the inner conductor contact (the signal contact member) 12 becomes an attached state. Then, the shell lid portion 13*c* of the shield shell 13 is pushed down to a substantially horizontal state such that the above-described connection member 13*c*1 is bent at a substantially right angle, and thus all of the fitting main body portion 11*a* and the wire connection support portion 11*b* of the insulation housing 11 are covered with the shell lid portion 13*c* from above, so that the shield shell 13 becomes a closed state (see FIGS. 1 to 3).

When the shell lid portion 13*c* is pushed down to the substantially horizontal state to be closed as described above, the shell lid portion is configured to cover the opening portion on the "upper side" (in the positive direction of the Z axis in the drawing) of the outer conductor shell 13*a*, while a portion closer to the "rear side" (in the negative direction of the Y axis in the drawing) of the shell lid portion 13*c* pushed down to the substantially horizontal state is a rear cover portion 13*c*2, and the rear cover portion 13*c*2 is configured to cover the wire connection support portion 11*b* of the insulation housing 11, the shell projection 13*b* of the shield shell 13, and the outer conductor (the shield wire) SCb of the coaxial cable SC from above.

As described above, the rear cover portion 13*c*2 constitutes a portion closer to the "rear side" (in the negative direction of the Y axis in the drawing) of the shell lid portion 13*c*, while a first fixation holding plate 13*c*3 and a second fixation holding plate 13*c*4 formed of a pair of tongue-shaped members are provided on both side edge portions of the rear cover portion 13*c*2 in the "left-right direction" (the positive-negative direction of the X axis in the drawing) to form a flange plate shape. The first fixation holding plate

13*c*3 is bent to cover the shell projection 13*b* of the shield shell 13 from the outside and is clamped thereto.

Both flange plates forming the pair of first fixation holding plates 13*c*3 and 13*c*3 are disposed to be positioned outside the shell projection 13*b* of the shield shell 13 in the "left-right direction" (the positive-negative direction of the X axis in the drawing) when the shell lid portion 13*c* is pushed down to the substantially horizontal state, and are bent inward with respect to the connector along both outer wall surfaces of the shell projection 13*b* to perform clamping in this state, so that the shell lid portion 13*c* is fixed to the outer conductor shell 13*a*, and the shell projection 13*b* that covers an outer surface of the wire connection support portion 11*b* of the insulation housing 11 in the "left-right direction" (the positive-negative direction of the X axis in the drawing) is fixed to the shell lid portion 13*c*.

Further, these first fixation holding plates 13*c*3 and 13*c*3 are provided with protrusions 13*c*5 and 13*c*5 that protrude inward with respect to the connector in the "left-right direction" (the positive-negative direction of the X axis in the drawing) (see FIG. 4), and the protrusions 13*c*5 and 13*c*5 are formed to be brought into contact with a part of the outer conductor (the shield wire) SCb of the coaxial cable SC when the first fixation holding plates 13*c*3 and 13*c*3 are bent inward with respect to the connector.

Furthermore, the second fixation holding plate 13*c*4 is provided to be adjacent and juxtaposed to the "rear side" (in the negative direction of the Y axis in the drawing) of the above-described first fixation holding plate 13*e*3, and is formed of a flange plate that is relatively small in size. The second fixation holding plate 13*c*4 is bent to cover the outer conductor (the shield wire) SCb of the coaxial cable SC from the outside and is clamped thereto.

Both flange plates forming the second fixation holding plate 13*c*4 are disposed to be positioned outside the outer conductor (the shield wire) SCb of the coaxial cable SC when the shell lid portion 13*c* is pushed down to the substantially horizontal state, and are bent inward with respect to the connector to perform crimping in this state. Therefore, the shell lid portion 13*c* is fixed to the outer conductor (the shield wire) SCb of the coaxial cable SC, and the outer conductor SCb is brought to contact with the second fixation holding plate 13*c*4, so that a ground circuit is formed by the shield shell 13.

Further, the outer conductor SCb may be brought into contact with the second fixation holding plate 13*c*4, but a front fixation holding plate may be further provided, and thus the outer periphery covering material SCd is fixed thereby.

[Example Methods of Forming Contact Assembly and Methods of Assembling Inner Conductor Contact]

Hereinafter, an example method of manufacturing an electrical connector is described. The method of manufacturing the electrical connector includes contacting an end portion of a center conductor SCa exposed in an end portion of a coaxial cable SC having the center conductor with a conductive contact 12. The method further includes applying ultrasonic vibration to the end portion of the center conductor SCa and the contact 12 to join the end portion of the center conductor SCa and the contact 12 to each other. The method further includes accommodating the contact 12 in an insulation housing 11 after the end portion of the center conductor SCa and the contact are joined to each other, and covering at least a part of a joint of the end portion of the center conductor SCa and the contact 12 with the insulation housing 11.

Applying the ultrasonic vibration to the end portion of the center conductor SCa and the contact 12 may include: sandwiching the end portion of the center conductor SCa and the contact 12 between a horn TH in contact with the end portion of the center conductor SCa and an anvil TA in contact with the contact 12; and applying the ultrasonic vibration to the horn TH while the end portion of the center conductor SCa and the contact 12 are sandwiched between the horn TH and the anvil TA.

The method may further include pressing the end portion of the center conductor SCa and the contact 12 by the horn TH and the anvil TA such that a cross section of the end portion of the center conductor SCa is plastically deformed from a circular shape to a non-circular shape while the ultrasonic vibration is applied to the horn TH.

The contact may have a joint surface 12*e*. Applying the ultrasonic vibration to the end portion of the center conductor SCa and the contact 12 may include applying the ultrasonic vibration to the horn TH while the end portion of the center conductor SCa is in contact with the joint surface 12*e* and the anvil TA is in contact with a back surface 12*f* of the joint surface 12*e*. Pressing the end portion of the center conductor SCa and the contact 12 may include forming a formed joint surface SCa53 along the joint surface 12*e* on an outer peripheral surface SCa50 of the end portion of the center conductor SCa by pressing.

Covering at least the part of the joint of the end portion of the center conductor SCa and the contact 12 with the insulation housing 11 may include covering the back surface 12*f* of the joint surface 12*e* with the insulation housing 11.

The horn TH may have a pressing surface THc1, THc2. Applying the ultrasonic vibration to the end portion of the center conductor SCa and the contact 12 may include applying the ultrasonic vibration to the horn TH while the pressing surface THc1 and THc2 are in contact with the end portion of the center conductor SCa. Pressing the end portion of the center conductor SCa and the contact 12 may include forming a formed outer surface SCa51, SCa52 along the pressing surface THc1, THc2 on the outer peripheral surface SCa50 of the end portion of the center conductor SCa by pressing.

The horn TH may have a pressing groove THa and an inner surface of the pressing groove includes the pressing surface THc1, THc2. Applying the ultrasonic vibration to the end portion of the center conductor SCa and the contact 12 may include applying the ultrasonic vibration to the horn TH while the end portion of the center conductor SCa fits into the pressing groove THa. Pressing the end portion of the center conductor SCa and the contact 12 may include forming the formed outer surface SCa51, SCa52 along the inner surface of the pressing groove THa on the outer peripheral surface SCa50 of the end portion of the center conductor SCa by pressing.

The inner surface of the pressing groove THa may have a first pressing surface THc1 and a second pressing surface THc2 that gradually approach each other toward a bottom of the pressing groove THa. Applying the ultrasonic vibration to the end portion of the center conductor SCa and the contact 12 may include applying the ultrasonic vibration to the horn TH while the outer peripheral surface SCa50 of the end portion of the center conductor SCa is in contact with the first pressing surface THc1 and the second pressing surface THc2. Pressing the end portion of the center conductor SCa and the contact 12 may include forming the formed outer surface including a first formed outer surface SCa51 along the first pressing surface THc1 and a second formed outer surface SCa52 along the second pressing surface THc2 on the outer peripheral surface SCa50 of the end portion of the center conductor SCa by pressing.

Accommodating the contact 12 in the insulation housing 11 and covering at least the part of the joint of the end portion of the center conductor SCa and the contact 12 with the insulation housing 11 may include press fitting the contact 12 to the insulation housing 11.

The insulation housing 11 may have a cavity 11*c*. Covering at least the part of the joint of the end portion of the center conductor SCa and the contact 12 with the insulation housing 11 may include accommodating the contact 12 in the cavity 11*c* of the insulation housing.

Next, examples relating to a method of forming a contact assembly in which the center conductor (the signal wire) SCa of the coaxial cable SC is joined to the above-mentioned inner conductor contact (the signal contact member) 12 by joining with ultrasonic vibration using an anvil and a horn, and a method of attaching the contact assembly formed by joining with ultrasonic vibration to the insulation housing 11 will be described in detail based on the drawings.

Figure 7:
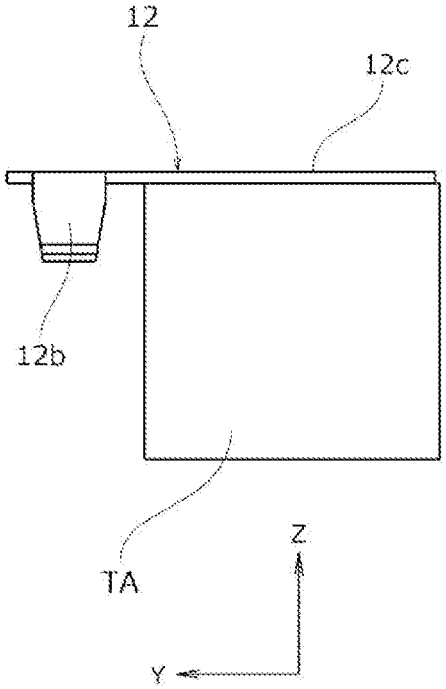
FIG. 7 is an explanatory side view showing a state in which the inner conductor contact (a signal contact member) is set on an anvil.
Figure 8:
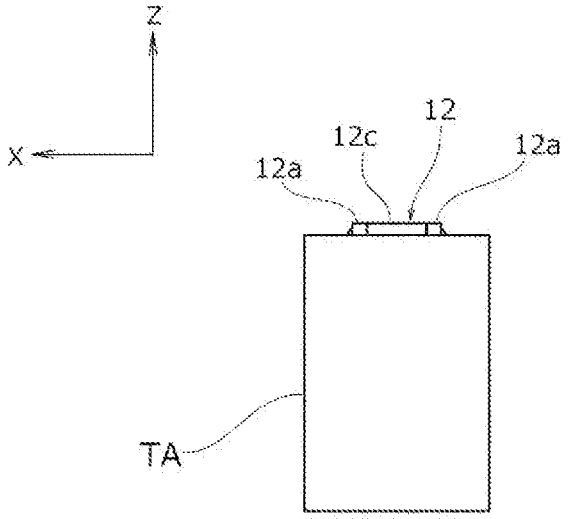
FIG. 8 is an explanatory rear view showing the state shown in FIG. 7.

First, as shown in FIGS. 7 and 8, the inner conductor contact (the signal contact member) 12 and an anvil TA serving as a member for receiving ultrasonic vibration are prepared, and an upper end surface of the anvil TA is brought into contact with the lower surface of the inner conductor contact (the signal contact member) 12.

Figure 9:
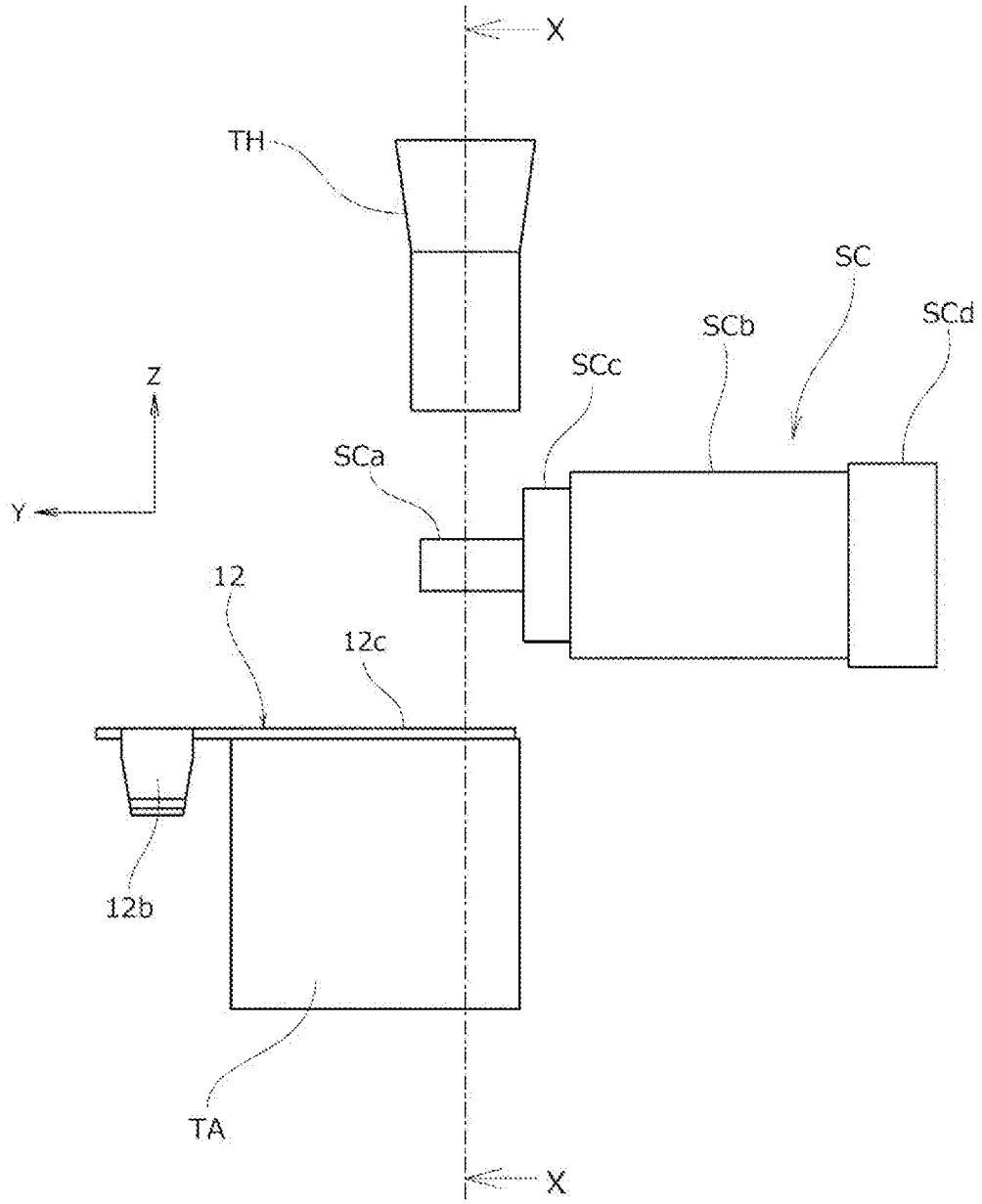
FIG. 9 is an explanatory side view showing a state before joining in which the terminal portion of a center conductor (a signal wire) of the coaxial cable is disposed above the inner conductor contact (the signal contact member) held on the anvil, and a horn is disposed above the center conductor (the signal wire) of the coaxial cable such that they face each other.
Figure 10:
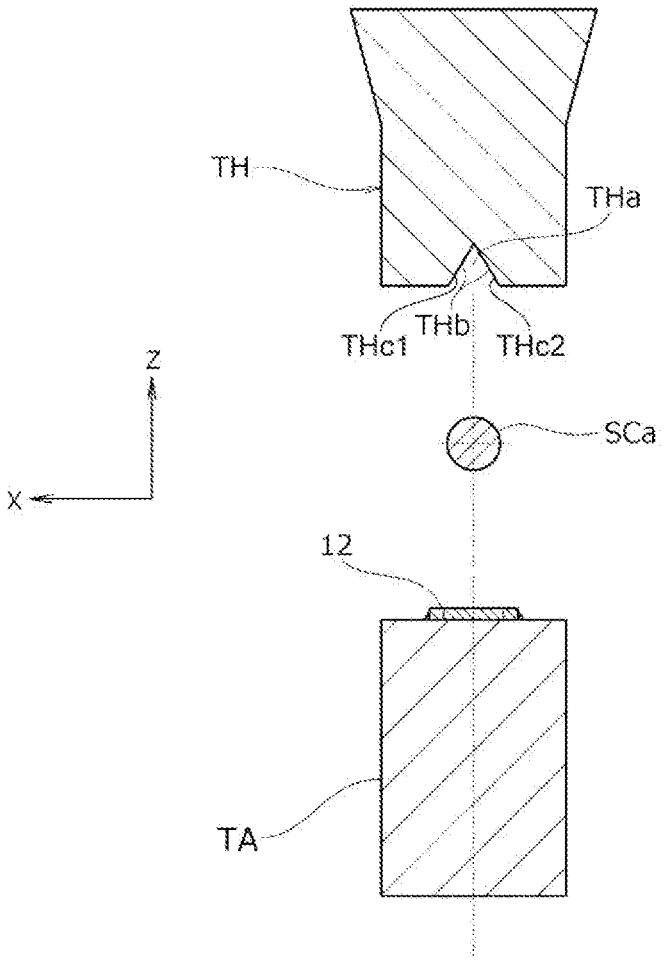
FIG. 10 is an explanatory cross-sectional view along line X-X in FIG. 9.

Next, as shown in FIGS. 9 and 10, the center conductor (the signal wire) SCa of the coaxial cable SC and the horn TH are prepared, and are disposed such that they face the "upper side" (in the positive direction of the Z axis in the drawing) of the anvil TA. The terminal portion of the center conductor (the signal wire) SCa of the coaxial cable SC is caused to face the flat portion of the flat plate portion 12*c* of the single inner conductor contact (the signal contact member) 12 which is closer to the "rear side" (in the negative direction of the Y axis in the drawing) from the "upper side" (in the positive direction of the Z axis in the drawing) (this state is the state of FIGS. 9 and 10), and then the center conductor (the signal wire) SCa of the coaxial cable SC is lowered in the negative direction of the Z axis in the drawing, so that the terminal portion of the center conductor (the signal wire) SCa of the coaxial cable SC is brought into contact with the flat portion on the "rear side" (in the negative direction of the Y axis in the drawing) of the inner conductor contact (the signal contact member) 12 from the "upper side" (in the positive direction of the Z axis in the drawing).

Figure 11:
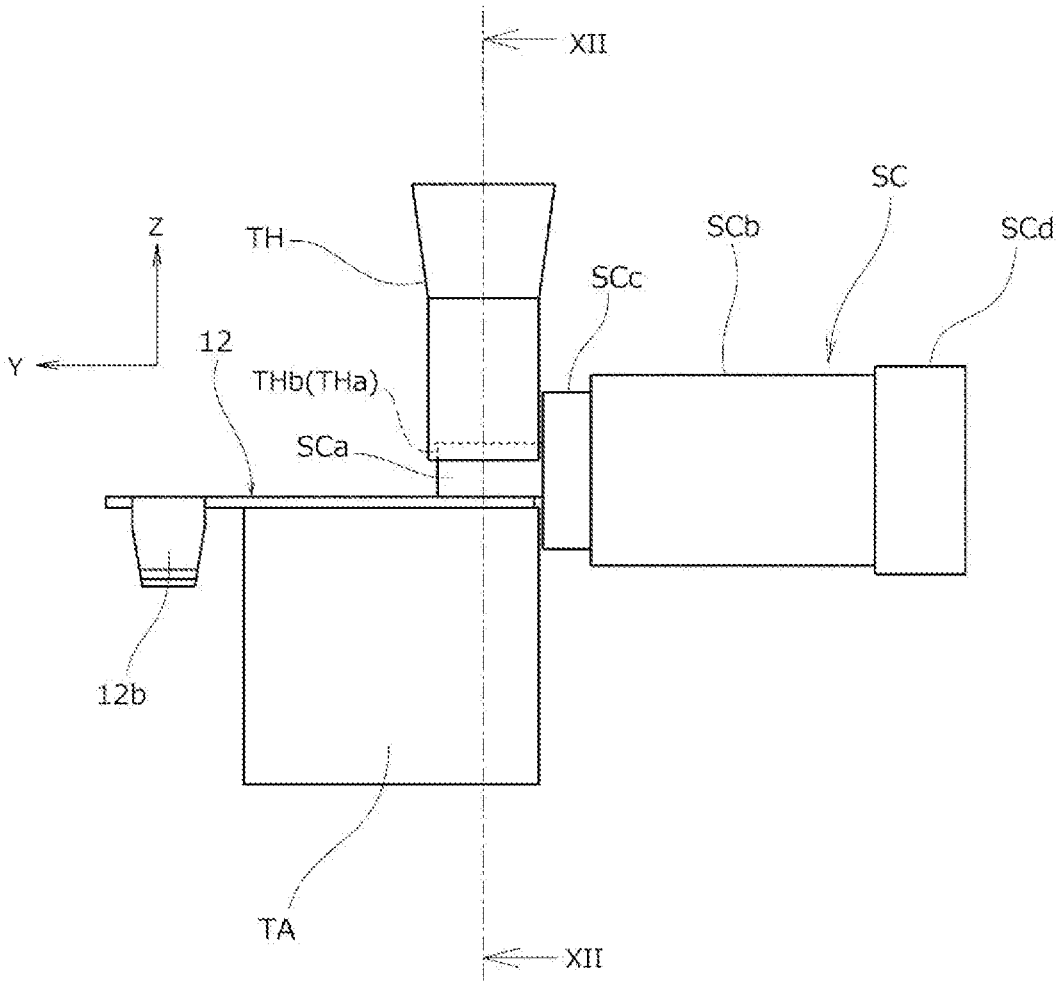
FIG. 11 is an explanatory side view showing a process in which the terminal portion of the center conductor (the signal wire) of the coaxial cable is brought into contact with the inner conductor contact (the signal contact member) held on the anvil from above and then the horn is lowered.
Figure 12:
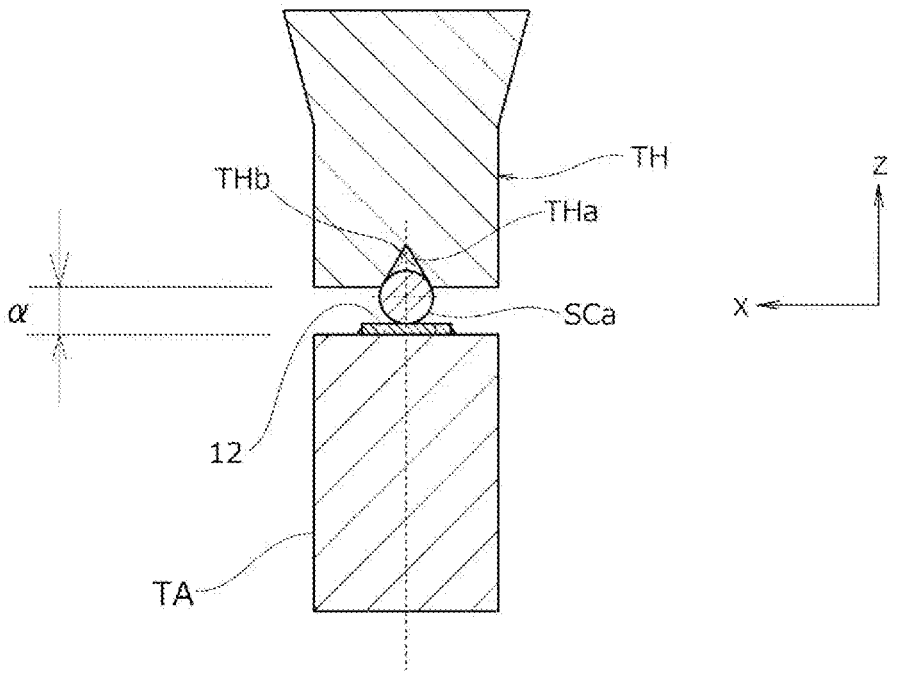
FIG. 12 is an explanatory cross-sectional view along line XII-XII in FIG. 11.
Figure 13:
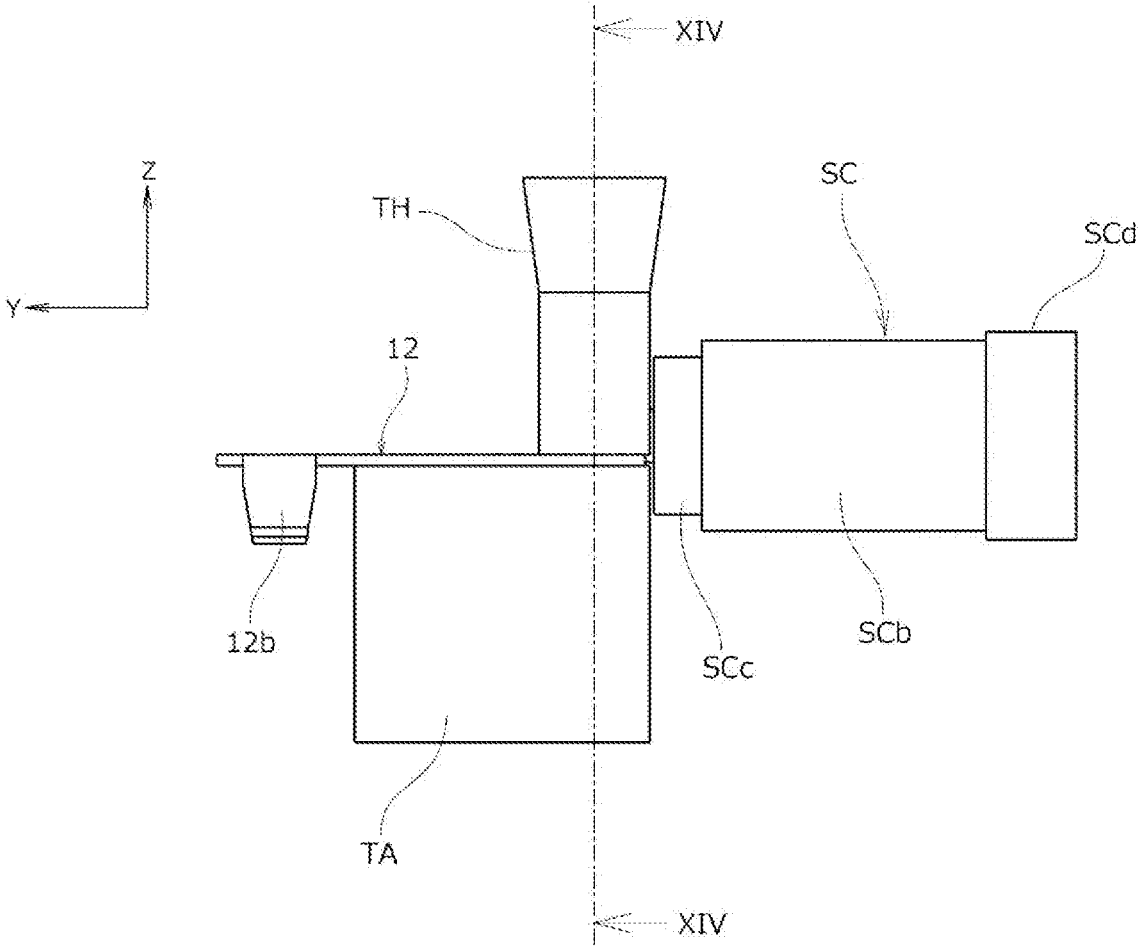
FIG. 13 is an explanatory side view showing a state in which a joining operation is performed, in which the horn is lowered from the state shown in FIG. 11 to press a tip end surface (a lower end surface) of the horn against the terminal portion of the center conductor (the signal wire) of the coaxial cable, and ultrasonic vibration is applied through the horn, wherein the horn has reached a lowering end.

Next, as shown in FIGS. 11 and 12, a tip end surface (a lower end surface) of the horn TH for applying ultrasonic vibration is lowered in the negative direction of the Z axis in the drawing with respect to the terminal portion of the center conductor (the signal wire) SCa of the coaxial cable SC that is in contact with the "upper side" (in the positive direction of the Z axis in the drawing) of the inner conductor contact (the signal contact member) 12, to be brought into contact with the terminal portion from the "upper side" (in the positive direction of the Z axis in the drawing). Then, in the state shown in FIGS. 11 and 12, a gap with which the horn TH and the anvil TA vertically face each other is set to a predetermined "α." In a state of having the gap α, the horn TH starts to apply ultrasonic vibration accompanied by heating and pressurization, and the horn TH is gradually lowered, being the state shown in FIGS. 13 and 14, that is, a state in which the gap between the horn TH and the anvil TA is changed until it reaches a predetermined "β."

As described above, in a state in which the inner conductor contact (the signal contact member) 12 and the center conductor (the signal wire) SCa of the coaxial cable SC are interposed between the horn TH and the anvil TA, the ultrasonic vibration is applied through the horn TH to perform a joining operation with ultrasonic vibration, but after such a joining operation is performed, the horn TH is raised to the original position in the positive direction of Z axis in the drawing as shown in FIG. 15, so that the contact assembly CA as shown in FIG. 16 in which the center conductor (the signal wire) SCa of the coaxial cable SC is rigidly joined to the inner conductor contact (the signal contact member) 12 is formed.

A recess THa (or the pressing groove THa) for accommodating the conductor (the signal wire) SCa of the coaxial cable SC is provided in the tip end surface (the lower end surface) of the horn TH which comes into contact with the center conductor (the signal wire) SCa of the above-described coaxial cable SC from the "upper side" (in the positive direction of the Z axis in the drawing). The recess THa provided in the tip end surface (the lower end surface) of the horn TH is formed by a groove-shaped portion extending in the extending direction (the front-rear direction) of the center conductor (the signal wire) SCa of the coaxial cable SC. The groove-shaped portion forming the recess THa has a groove opening having a groove width corresponding to an outer diameter of the center conductor (the signal wire) SCa of the coaxial cable SC in the tip end surface (the lower end surface) of the horn TH, and has groove side wall portions (or the pressing surfaces) THb and THb constituted by a pair of tapered surfaces extending in a direction (the upward direction in FIG. 10) from the groove opening toward a bottom portion of the groove-shaped portion.

In further detail, in the groove-shaped portion forming the recess THa of the tip end surface (the lower end surface) of the above-described horn TH, a cross-sectional shape in a direction orthogonal to the extending direction of the center conductor (the signal wire) SCa of the coaxial cable SC is a V shape. In some examples, an interval between the groove side wall portions THb and THb constituted by the pair of tapered surfaces constituting the groove-shaped portion of the recess THa is set to be the maximum groove width at the groove opening at a lower end, and becomes continuously narrower in the upward direction from the groove opening toward the bottom portion of the groove-shaped portion.

These groove side wall portions THb and THb are formed by two flat surfaces extending in the "front-rear direction" (the positive-negative direction of the Y axis in the drawing). Then, each of the two flat surfaces constituting each of the groove side wall portions THb has two end edges constituted by one end edge and another end edge extending in the extending direction (the positive-negative direction of the Y axis), and the one end edges of each of these two end edges are directly connected to each other.

As described above, if a cross-sectional shape of the recess THa provided in the tip end surface (the lower end surface) of the horn TH is the V shape, ultrasonic vibration is efficiently transmitted to the center conductor (the signal wire) SCa of the coaxial cable SC and the inner conductor contact (the signal contact member) 12 via the groove side wall portions THb and THb constituted by the tapered surface of the horn TH.

Figure 14:
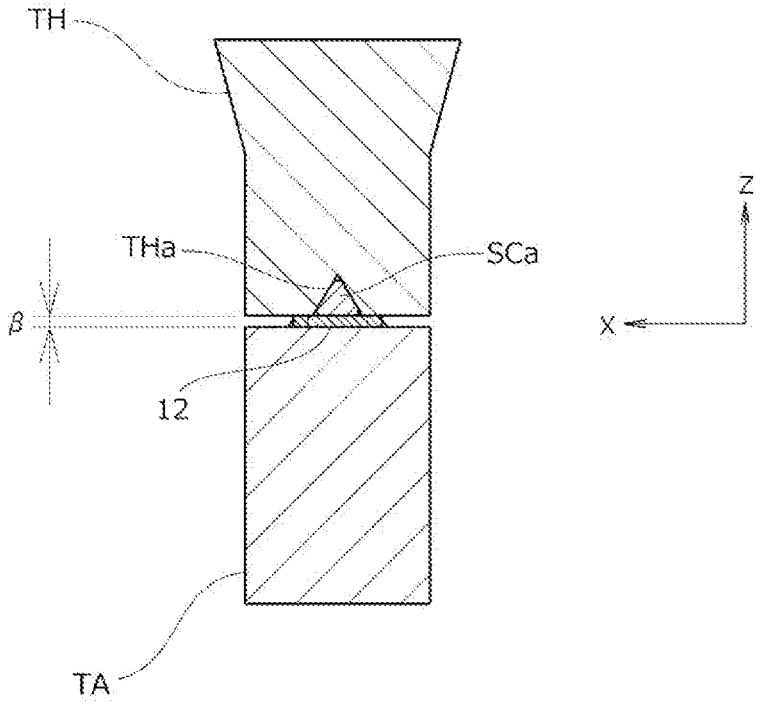
FIG. 14 is an explanatory cross-sectional view along line XIV-XIV in FIG. 13.

When the contact assembly CA is formed using the horn TH having the recess THa as described above, the terminal portion of the center conductor (the signal wire) SCa of the coaxial cable SC in the contact assembly CA may be formed by being plastically deformed into a cross-sectional shape corresponding to the recess THa of the horn TH, so that a cross section of the terminal portion in a direction orthogonal to the extending direction of the center conductor SCa has the polygonal shape (the substantially triangular shape) (see FIGS. 14 and 16). For example, an interval between a pair of other sides extending from both ends of one side of the center conductor (the signal wire) SCa (a side in contact with the inner conductor contact 12) becomes continuously narrower away from the inner conductor contact 12.

In this case, if the terminal portion of the center conductor (the signal wire) SCa of the coaxial cable SC is a single wire, a part thereof is plastically deformed to form the polygonal shape (the substantially triangular shape), while, if the terminal portion is a twisted wire constituted by a plurality of wires, respective wires are integrally plastically deformed to form the polygonal shape (the substantially triangular shape).

In some examples, the cross-sectional shape of the groove-shaped portion in the tip end surface of the horn TH is the V shape, but the cross-sectional shape may include other shapes in which the interval between the pair of groove side wall portions THb and THb becomes narrower from the groove opening toward a groove bottom portion. For example, the groove side wall portion THb may be fainted in a step shape. Further, the groove bottom portion of the horn TH may have an angular shape, a curved shape, or a linear shape. In the resultant terminal portion of the center conductor (the signal wire) SCa of the coaxial cable SC, the cross-sectional shape of the groove-shaped portion in the tip end surface of the horn TH is reflected.

Next, an assembling operation in which the contact assembly CA formed in the above-described joining operation with ultrasonic vibration is taken out from the anvil TA serving as a member for receiving ultrasonic vibration to be attached to the insulation housing 11 is performed. In this assembling operation, first, as shown in FIG. 17, the contact assembly CA held by an appropriate means is disposed on the "upper side" (in the positive direction of the Z axis in the drawing) of the contact accommodating space 11*c* of the insulation housing 11 already assembled to the shield shell 13, and the inner conductor contact (the signal contact member) 12 of the contact assembly CA is inserted into the contact accommodating space 11*c*. Therefore, as shown in FIGS. 18 and 19, the attaching of the contact assembly CA is performed. By tightly press-fitting the locking piece 12*a* of the inner conductor contact (the signal contact member) 12 of the contact assembly CA into the insulation housing 11 such that the locking piece bite the insulation housing, the attaching of the contact assembly CA is performed.

According to such a method of manufacturing the plug connector 10, a jig such as a horn TH for applying ultrasonic vibration or an anvil TA is used in a place independent of the insulation housing 11, and thus the jig is not inserted into the insulation housing 11 when used, unlike the related art. Therefore, the restriction in designing the insulation housing 11 decreases to that extent, and the degree of freedom in design increases, so that the size of the plug connector 10 may be reduced. Further, since the horn TH that is a jig for applying ultrasonic vibration or the anvil TA are also not restricted by the structure of the insulation housing 11, the horn TH and the anvil TA may be designed so as to obtaining an optimum resonance point, and ultrasonic vibration can be efficiently applied, so that sufficient joining strength may be obtained.

In a semi-finished product (see FIGS. 18 and 19) of the plug connector 10 obtained in such a manner, the connection member 13*c*1 is bent at a substantially right angle, and thus the shield shell 13 is closed and the first fixation holding plate 13*c*3 and the second fixation holding plate 13*c*4 is bent to perform clamping such that the first fixation holding plate and the second fixation holding plate cover the insulation housing and the coaxial cable from the outside, so that the electrical connector 10 is completed.

Figure 36:
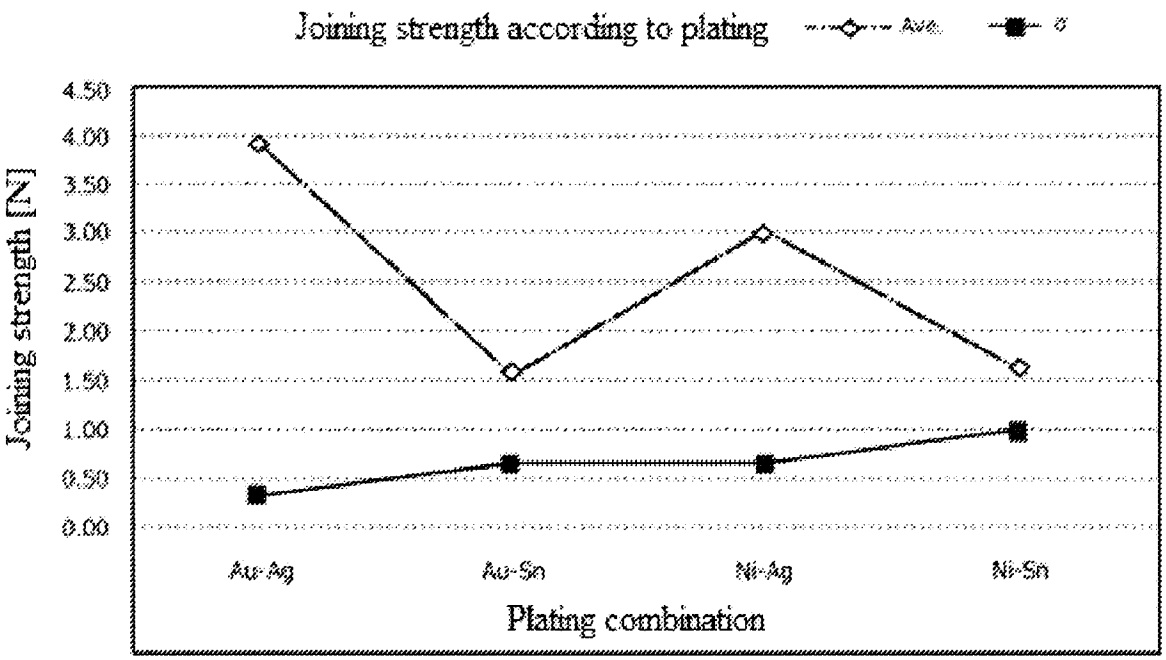
FIG. 36 is an explanatory illustration of the joining strength of an electrical connector according to different plating combinations for ultrasonic joining.

The terminal portion of the center conductor SCa of the coaxial cable SC may be "silver plated" as described above, but in the flat plate portion 12*c* of the inner conductor contact (the signal contact member) 12 to be joined, at least a portion to which the center conductor SCa of the coaxial cable SC is joined is "gold plated." In a case in which joining is performed with ultrasonic vibration in a state in which gold (Au) and silver (Ag) are combined in this way, as shown in Table I below and as illustrated in FIG. 36 greater joining strength (Ave.) can be obtained and variation (σ) in joining strength is reduced as compared with the case of joining with ultrasonic vibration in combinations of other metals (Au—Sn, Ni—Ag, Ni—Sn).

TABLE 1

Joining strength according to ultrasonic joining plating

| Combination | | Au—Ag | Au—Sn | Ni—Ag | Ni—Sn |
|---|---|---|---|---|---|
| Terminal (M-CT) | | Au | Au | Ni | Ni |
| Cable | | Ag | Sn | Ag | Sn |
| Joining strength | Ave. | 3.93 | 1.56 | 3.04 | 1.61 |
| [N] | σ | 0.31 | 0.63 | 0.60 | 0.96 |

Next, the configuration of another example according to FIG. 20 in which "10" is added to the reference numerals given to the same members as those in the above-described embodiment will be described.

Figure 20:
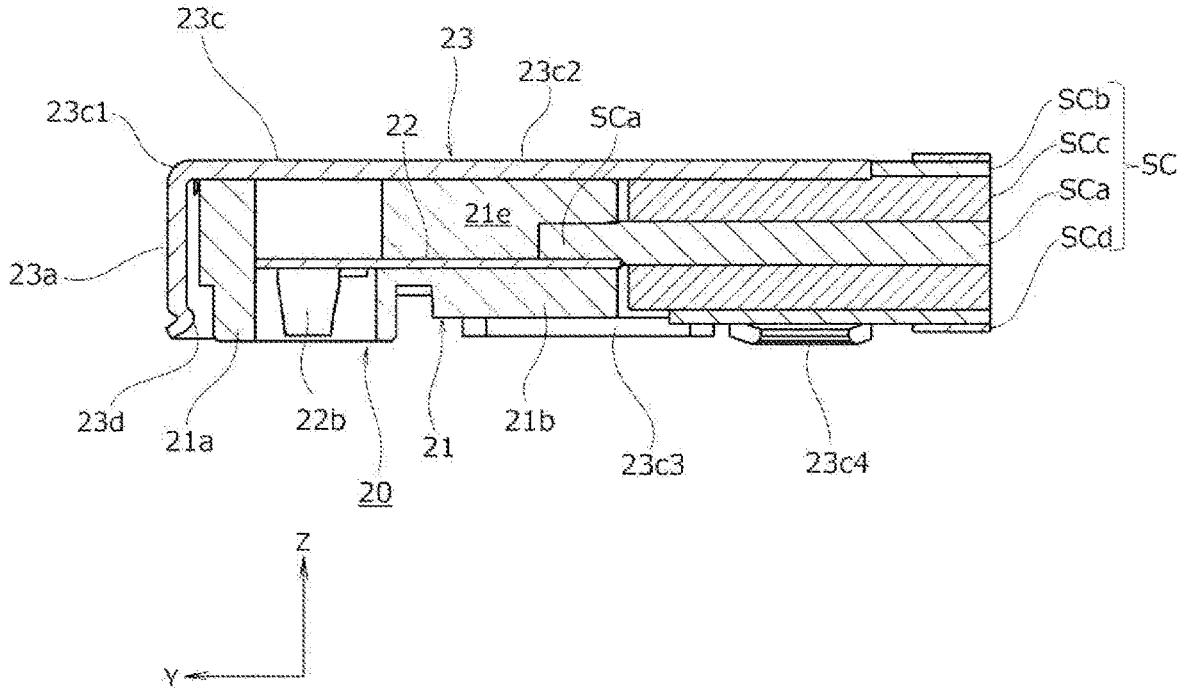
FIG. 20 is an explanatory longitudinal sectional view showing a state in which a coaxial cable is connected to an electrical connector (a plug connector) according to another example.

As shown in FIG. 20, a connection portion between an inner conductor contact (a signal contact member) 22 and the center conductor SCa which is a signal wire of the coaxial cable SC is embedded in a connection filling portion 21*e* that forms a part of an insulation housing 21 by the insert molding.

In the method of manufacturing an electrical connector according to this example, accommodating the contact 22 in the insulation housing 21 and covering at least the part of the joint of the end portion of the center conductor SCa and the contact 22 with the insulation housing 21 may include putting the contact 22 into a mold and injecting a molten resin into the mold to mold the insulation housing 21. Injecting the molten resin into the mold to mold the insulation housing 21 may include wrapping the joint of the end portion of the center conductor SCa and the contact 22 with the molten resin to bury the joint of the end portion of the center conductor SCa and the contact 22 in the insulation housing 21. When performing the insert molding of the configuration in which the electrical connection portion is embedded in the connection filling portion 21*e* of such an insulation housing 21, first, the inner conductor contact (the signal contact member) 22 and the center conductor (the signal wire) SCa of the coaxial cable SC are joined to each other by application of ultrasonic vibration similar to that in the above-described example to form the contact assembly CA, the contact assembly CA is set in a mold prepared in advance, and the insert molding is performed. Accordingly, the electrical connector is manufactured.

In other examples, the connection portion between the inner conductor contact (the signal contact member) 22 and the center conductor (the signal wire) SCa of the coaxial cable SC is held by the insulation housing 21, so that the electrical connection state of the electrical connector is stabilized and strength thereof is improved.

In some examples, the terminal portion of the center conductor (the signal wire) SCa of the coaxial cable SC is formed by being plastically deformed into a cross-sectional shape corresponding to the recess THa of the horn TH. By forming a recess also in the anvil TA disposed facing the recess THa of the horn TH, or by using a molding die other than the horn TH or the anvil TA, the terminal portion of the center conductor (the signal wire) SCa of the coaxial cable SC may be made to have a cross-sectional shape shown in each of the following examples.

As shown in FIGS. 21 to 28, respective terminal portions of the center conductors (the signal wires) SCa1 to SCa4 of coaxial cables SC1 to SC4 have first surface portions SCa11 to SCa41 and second surface portions SCa12 to SCa42 which face each other in a direction (the positive-negative direction of the Z axis in the drawing) orthogonal to the extending direction (the positive-negative direction of the Y axis in the drawing) of the center conductors (the signal wires) SCa1 to SCa4. Further, any one of the first surface portions SCa11 to SCa41 and the second surface portions SCa12 to SCa42 is connected to an inner conductor contact (a signal contact member) 32 shown in FIGS. 29 and 30.

Figure 21:
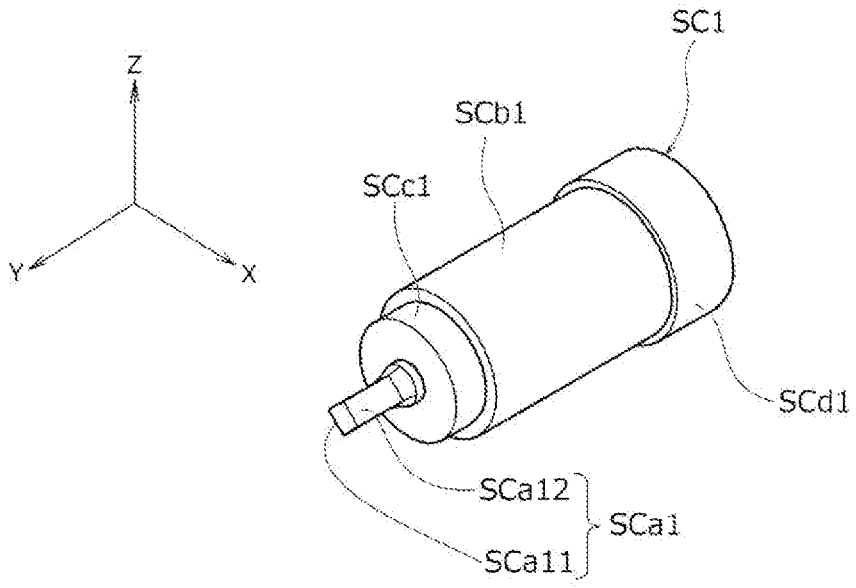
FIG. 21 is an explanatory external perspective view showing a terminal portion of a coaxial cable according to still another example, as viewed from the front upper side.
Figure 22:
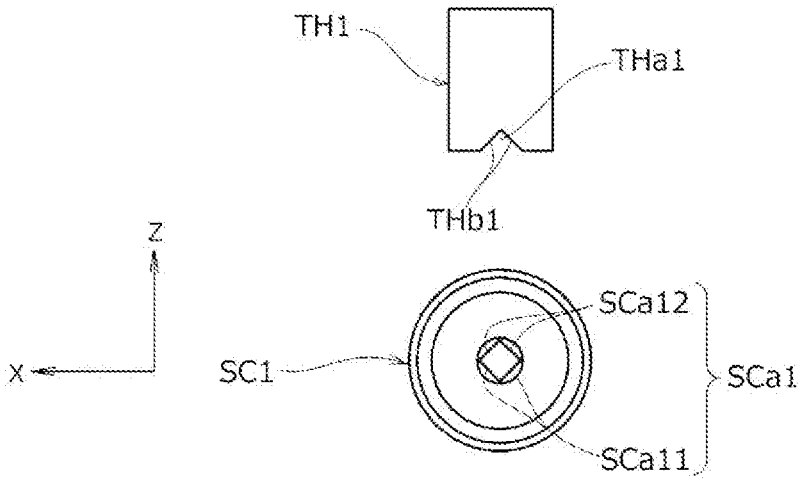
FIG. 22 is an explanatory front view showing a state in which a horn is disposed above a terminal portion of a center conductor (a signal wire) of the coaxial cable according to the example shown in FIG. 21 such that they face each other.

Among them, first, in the center conductor (the signal wire) SCa1 of the coaxial cable SC1 according to the example shown in FIGS. 21 and 22, a cross-sectional shape in a direction (the positive-negative direction of the Z axis in the drawing) orthogonal to the extending direction (the positive-negative direction of the Y axis in the drawing) of the center conductor (the signal wire) SCa1 is a "rhombic shape." In some examples, a lower surface to be connected to the inner conductor contact (the signal contact member) 32 which will be described later is the first surface portion SCa11 constituted by two flat surfaces, and the second surface portion SCa12 disposed such that it faces the first surface portion SCa11 from above is also constituted by two flat surfaces.

Then, each of the two flat surfaces constituting each of these first surface portion SCa11 and second surface portion SCa12 extends in the positive-negative direction of the Y axis in the drawing in a state in which it is inclined in a direction intersecting with the extending direction (the positive-negative direction of the Y axis in the drawing) of the center conductor (the signal wire) SCa1 of the coaxial cable SC1, for example, in a direction intersecting therewith at about 45 degrees. Then, each of these two flat surfaces has two end edges constituted by one end edge and another end edge extending in the extending direction (the positive-negative direction of the Y axis in the drawing), and the one end edges of each of the flat surfaces are directly connected to each other, so that a cross-sectional shape of the center conductor (the signal wire) SCa1 in a direction orthogonal to the extending direction (the positive-negative direction of the Y axis in the drawing) is a "rhombic shape."

A tip end surface (a lower end surface) of a horn TH1 (or instead, a molding die) for forming an upper surface of the center conductor (the signal wire) SCa1 of the coaxial cable SC1 having such a rhombic cross-sectional shape has a configuration similar to that of the above-described example. For example, the tip end surface (the lower end surface) of the horn TH1 (or instead, a molding die) shown in FIG. 22 is provided with a recess THa1 constituted by a groove-shaped portion of which a cross-sectional shape in a direction (the positive-negative direction of the Z axis in the drawing) orthogonal to the extending direction (the positive-negative direction of the Y axis in the drawing) of the center conductor (signal wire) SCa1 of the coaxial cable SC1 is recessed in the "V shape."

An interval between groove side wall portions THb1 and THb1 constituted by a pair of tapered surfaces constituting the groove-shaped portion of the recess THa1 of the above-described horn TH1 (or instead, a molding die) is set to be the maximum groove width at the groove opening at a lower end, and becomes continuously narrower in the upward direction from the groove opening toward the bottom portion of the groove-shaped portion. The groove side wall portions THb1 and THb1 of the horn TH1 are constituted by two flat surfaces extending in the "front-rear direction" (the positive-negative direction of the Y axis in the drawing), while each of the two flat surfaces constituting these groove side wall portions THb1 and THb1 has two end edges constituted by one end edge and another end edge extending in the extending direction (the positive-negative direction of the Y axis), and the one end edges of each of these two end edges are directly connected to each other.

Figure 35:
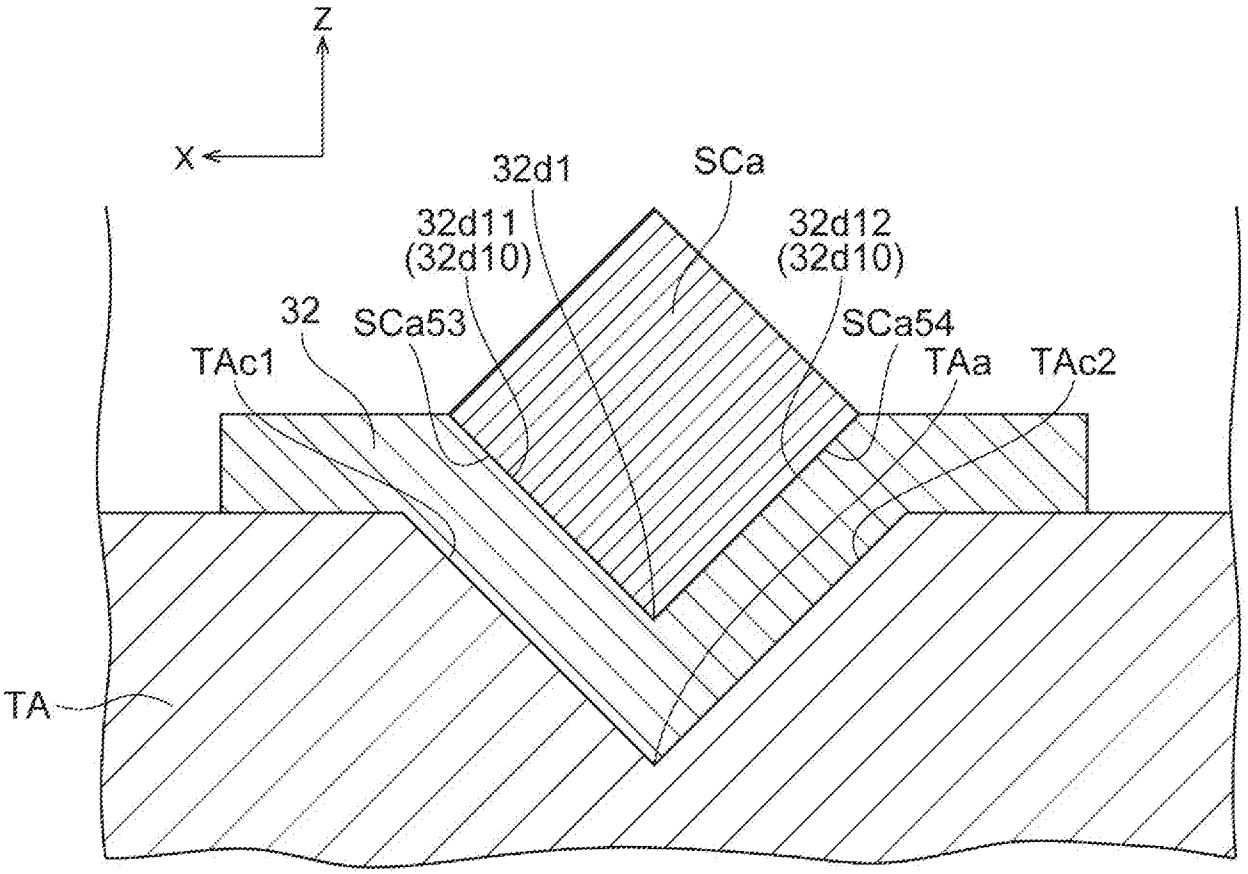
FIG. 35 is an explanatory cross-sectional view of an anvil having a groove, the contact shown in FIGS. 29 and 30, and the center conductor of the coaxial cable.

Further, as shown in FIG. 35, a receiving surface of the anvil (or instead, a molding die) for forming a lower surface (a contact connection surface) of the center conductor (the signal wire) SCa1 of the coaxial cable SC1 is also provided with a groove-shaped recess of which a cross-sectional shape in a direction orthogonal to the extending direction (the positive-negative direction of the Y axis) of the center conductor (the signal wire) SCa1 of the coaxial cable SC1 is recessed in the "V shape," and an interval between groove side wall portions constituted by a pair of tapered surfaces constituting the groove-shaped recess is set to be the maximum groove width at the groove opening at an upper end, and becomes continuously narrower in the downward direction from the groove opening toward the bottom portion of the groove-shaped portion.

The groove side wall portions of the anvil (or instead, a molding die) may also be constituted by two flat surfaces extending in the "front-rear direction" (the positive-negative direction of the Y axis in the drawing), each of the two flat surfaces has two end edges constituted by one end edge and another end edge extending in the "front-rear direction", and the one end edges of each of these two end edges are directly connected to each other. The configuration of the receiving surface of the anvil (or instead, a molding die) is the same in at least some of the following examples.

As described above, if a cross-sectional shape of the recess THa1 provided in the tip end surface (the lower end surface) of the horn TH1 (or instead, a molding die) is the V shape, when performing the joining with ultrasonic vibration, the ultrasonic vibration is efficiently transmitted to the first surface portion SCa11 of the center conductor (the signal wire) SCa1 of the coaxial cable SC1 and the inner conductor contact (the signal contact member) 32 that will be described later via the groove side wall portions THb1 and THb1 constituted by the tapered surfaces of the horn TH1.

Further, since the two flat surfaces constituting the first surface portion SCa11 of the center conductor (the signal wire) SCa1 of the coaxial cable SC1 serve as a lower surface to be connected to the inner conductor contact (the signal contact member) 32 that will be described later, a contact area between the center conductor (the signal wire) SCa1 of the coaxial cable SC1 and the inner conductor contact (the signal contact member) 32 increases, and thus sufficient joining strength may be obtained when performing the joining with ultrasonic vibration.

In the center conductor (the signal wire) SCa1 of the coaxial cable SC1 according to the example shown in FIGS. 21 and 22, the first surface portion SCal1 constituting the terminal portion of the center conductor (the signal wire)

Figure 29:
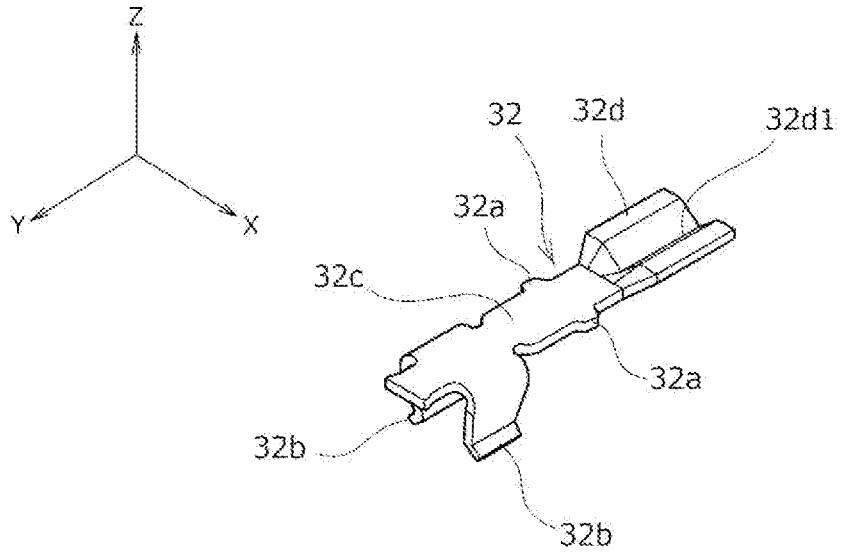
FIG. 29 is an explanatory external perspective view showing a single product of an inner conductor contact (a signal contact member) to which the center conductor (the signal wire) of the coaxial cable according to the examples shown in FIGS. 21 to 28 is connected, as viewed from the front upper side.
Figure 30:
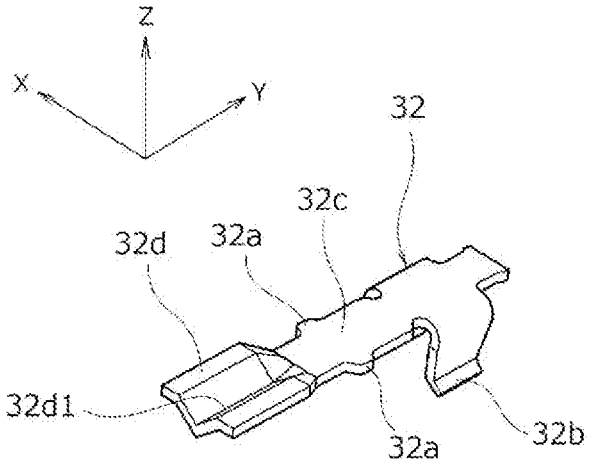
FIG. 30 is an explanatory external perspective view showing a single product of an inner conductor contact (a signal contact member) according to another example shown in FIG. 29, as viewed from the back upper side.

SCa1 is connected to a connection portion 32*d* provided in the inner conductor contact (the signal contact member) 32 shown in FIGS. 29 and 30 to be placed from the "upper side" (in the positive direction of the Z axis in the drawing). Here, the connection portion 32*d* of the inner conductor contact (the signal contact member) 32 is provided with a groove portion 32*d*1 extending in the "front-rear direction" (the positive-negative direction of the Y axis in the drawing) which is the extending direction of the center conductor (the signal wire) SCa1 of the coaxial cable SC1.

The groove portion 32*d*1 provided in the inner conductor contact (the signal contact member) 32 has a shape corresponding to the first surface portion SCal1 constituting the terminal portion of the center conductor (the signal wire) SCa1 of the above-described coaxial cable SC1, or for example, the "V shape" which is a shape of a cross section in a direction orthogonal to the extending direction (the positive-negative direction of the Y axis in the drawing) of the center conductor (the signal wire) SCa1 of the coaxial cable SC1. After the center conductor (the signal wire) SCa1 of the coaxial cable SC1 is placed on the groove portion 32*d*1 provided in the inner conductor contact (the signal contact member) 32 in the state of being in surface-contact therewith in the "vertical direction" (the positive-negative direction of the Z axis in the drawing), ultrasonic vibration is applied to the center conductor and the inner conductor contact, and thus the center conductor and the inner conductor contact are connected to each other.

In a case in which the first surface portion SCa11 of the center conductor (the signal wire) SCa1 of the coaxial cable SC1 to be connected to the inner conductor contact (the signal contact member) 32 extends in another cross-sectional shape such as an "arc shape" or a "polygonal shape," for example, in correspondence with this, the groove portion 32*d*1 (or a joint groove) of the above-described inner conductor contact (the signal contact member) 32 has a cross-sectional shape of the "arc shape" or the "polygonal shape" in a direction orthogonal to the extending direction.

As shown in FIG. 35, in the method of manufacturing an electrical connector according to the examples which are illustrated with reference to FIGS. 21 to 30, the contact 32 may have a joint groove 32*d*1 and an inner surface 32*d*10 of the joint groove 32*d*1 may include the joint surface. Applying the ultrasonic vibration to the end portion of the center conductor SCa and the contact 32 may include applying the ultrasonic vibration to the horn TH while the outer peripheral surface of the end portion of the center conductor SCa is in contact with the inner surface 32*d*10 of the joint groove 32*d*1. Pressing the end portion of the center conductor SCa and the contact 32 may include forming the formed joint surface SCa53, SCa54 along the inner surface 32*d*10 of the joint groove 32*d*1 on the outer peripheral surface of the end portion of the center conductor SCa by pressing.

The joint surface may include a first joint surface 32*d*11 and a second joint surface 32*d*12 that gradually approach each other toward a bottom of the joint groove 32*d*1. Applying the ultrasonic vibration to the end portion of the center conductor SCa and the contact 32 may include applying the ultrasonic vibration to the horn TH while the outer peripheral surface of the end portion of the center conductor SCa is in contact with the first joint surface 32*d*11 and the second joint surface 32*d*12. Pressing the end portion of the center conductor SCa and the contact 32 may include forming the formed joint surface including a first formed joint surface SCa53 along the first joint surface 32*d*11 and a second formed joint surface SCa54 along the second joint surface 32*d*12 on the outer peripheral surface of the end portion of the center conductor 32 by pressing.

The anvil TA may have a supporting groove TAa and an inner surface of the supporting groove TAa may include a first supporting surface TAc1 and a second supporting surface TAc2 that gradually approach each other toward a bottom of the supporting groove TAa. Pressing the end portion of the center conductor SCa and the contact 32 may include pressing the end portion of the center conductor SCa and the contact 32 by the horn TH and the anvil TA while the first supporting surface TAc1 faces a back surface of the first joint surface 32*d*11 and the second supporting surface TAc2 faces a back surface of the second joint surface 32*d*12.

Figure 31:
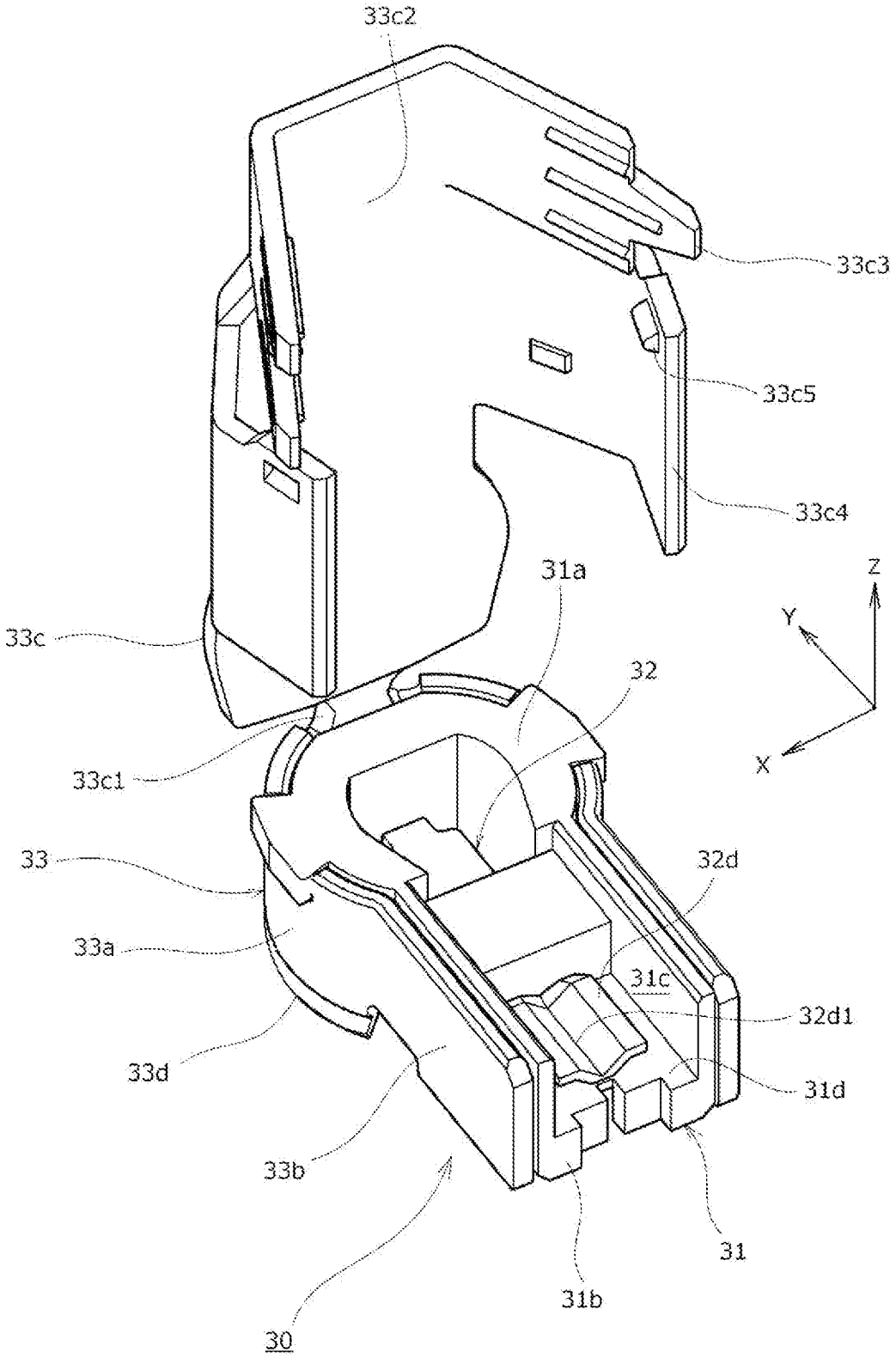
FIG. 31 is an explanatory external perspective view showing a state in which a shield shell is attached to the inner conductor contact (the signal contact member) shown in FIGS. 29 and 30, as viewed from the back upper side.

In connecting the terminal portion of the center conductor (the signal wire) SCa1 of the coaxial cable SC1 shown in FIG. 21 to the inner conductor contact (the signal contact member) 32 according to the example shown in FIGS. 29 and 30, as shown in FIG. 31, in a plug connector 30 before completion, the inner conductor contact (the signal contact member) 32 is previously attached to an insulation housing 31 attached to a shield shell 33, by the press-fitting or insert molding. That is, in this state, the connection portion 32*d* of the inner conductor contact (the signal contact member) 32 is disposed on the bottom wall surface 31*d* of the contact accommodating space 31*c* of the insulation housing 31 in a state in which the connection portion is exposed.

Figure 32:
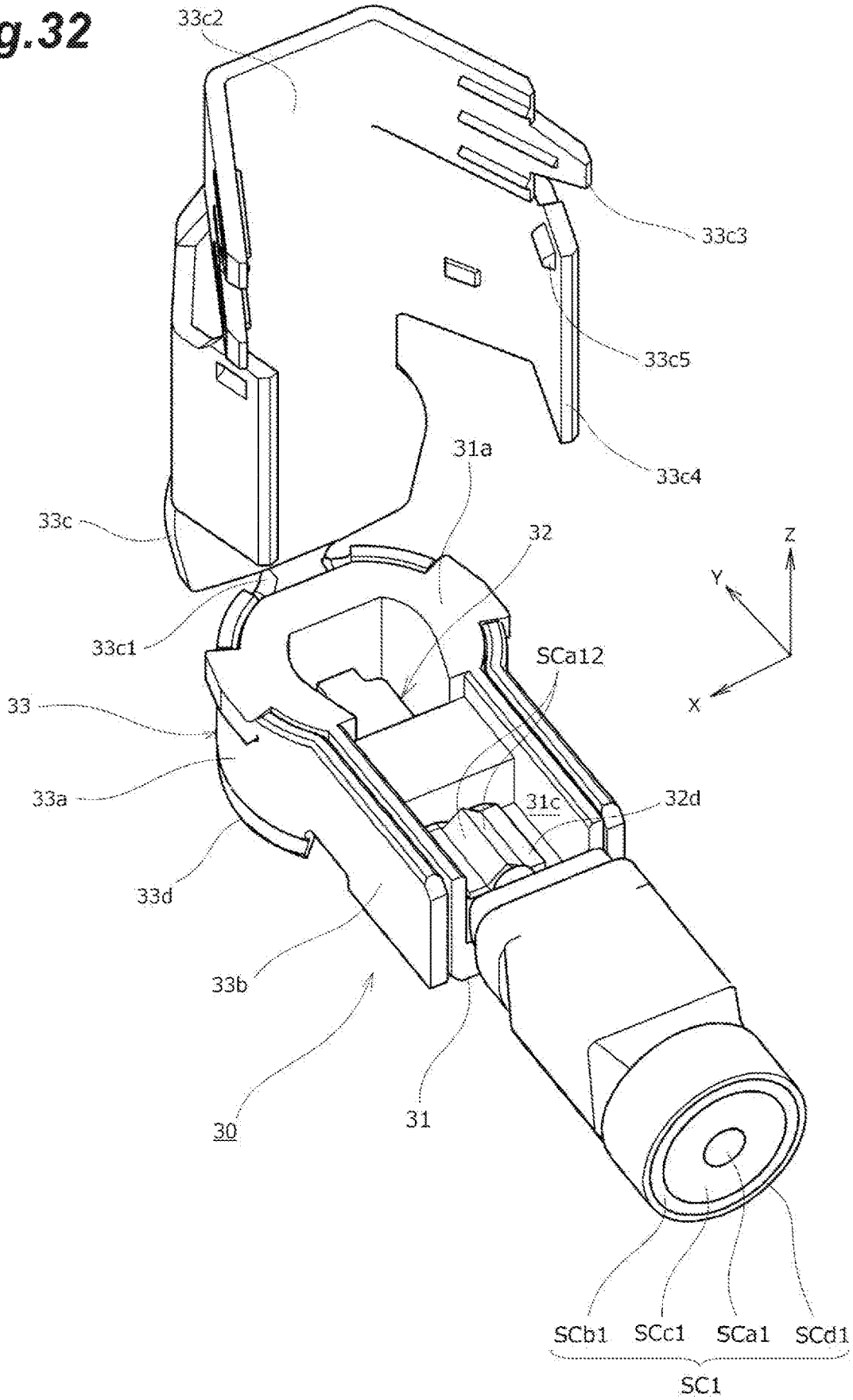
FIG. 32 is an explanatory external perspective view showing a state in which the center conductor (the signal wire) of the coaxial cable is joined to the inner conductor contact (the signal contact member) shown in FIG. 31, as viewed from the back upper side.

Next, after the terminal portion of the center conductor (the signal wire) SCa1 of the coaxial cable SC1 is disposed above the connection portion 32*d* of the above-described inner conductor contact (the signal contact member) 32, as shown in FIG. 32, the entire coaxial cable SC1 is lowered to bring the center conductor (the signal wire) SCa1 of the coaxial cable SC1 into contact with the connection portion 32*d* of the inner conductor contact (the signal contact member) 32, and then both members are interposed between the above-described horn TH and anvil to be fixed to each other by being joined with ultrasonic vibration using the horn and the anvil.

Figure 33:
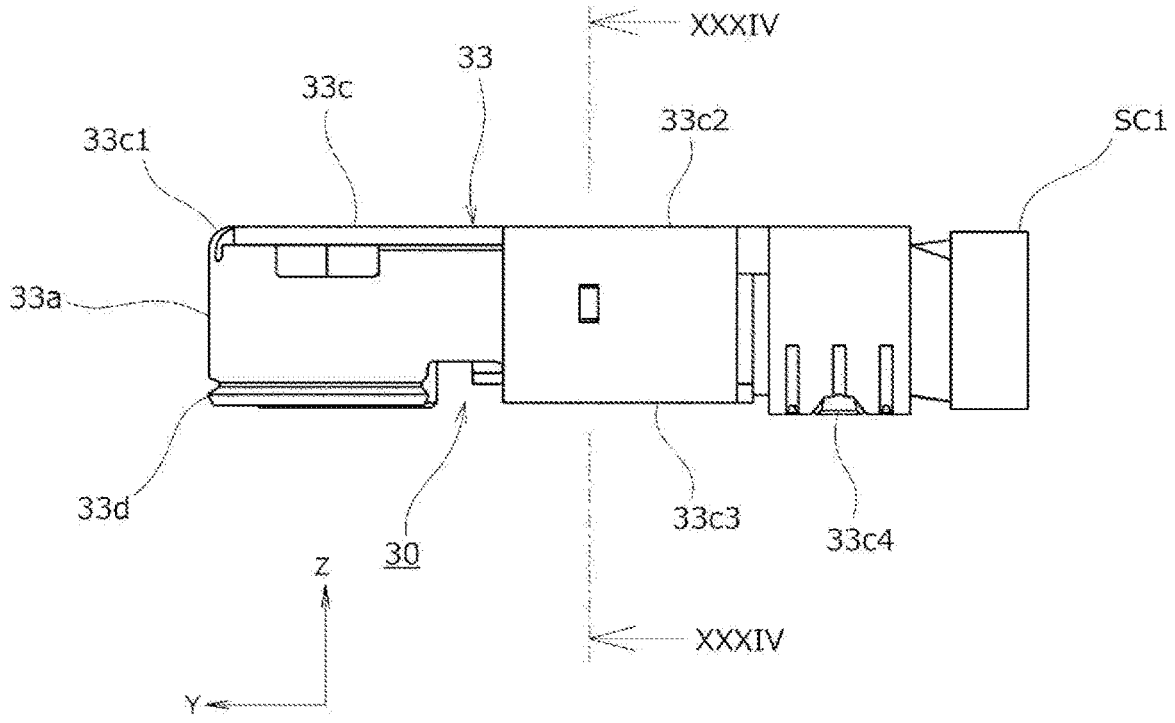
FIG. 33 is an explanatory side view showing a state in which the electrical connector according to the other example is set as a finished product with the shield shell closed from the state of FIG. 32.
Figure 34:
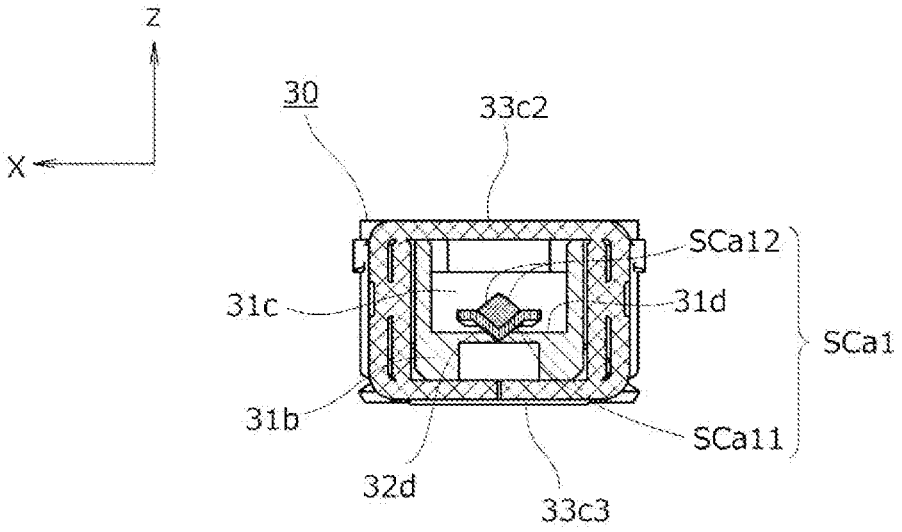
FIG. 34 is an explanatory cross-sectional view along line XXXIV-XXXIV in FIG. 33.

In a semi-finished product of the plug connector 30 obtained in such a manner, the connection member 33*c*1 of the shield shell 33 is bent at a substantially right angle, and thus the shield shell 33 is closed and a first fixation holding plate 33*c*3 and a second fixation holding plate 33*c*4 is bent to perform clamping such that the first fixation holding plate and the second fixation holding plate cover the insulation housing and the coaxial cable from the outside, so that, as shown in FIGS. 33 and 34, the electrical connector 30 is completed.

Figure 23:
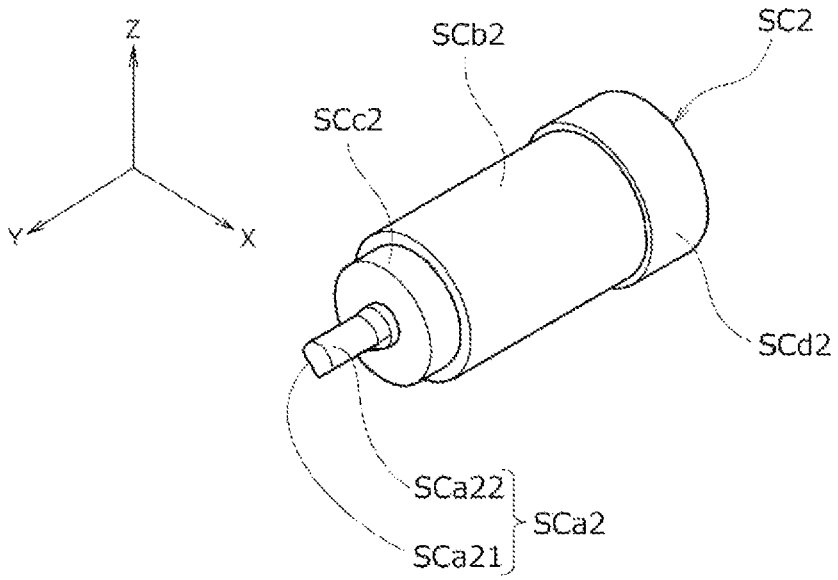
FIG. 23 is an explanatory external perspective view showing a terminal portion of a coaxial cable according to still another example, as viewed from the front upper side.
Figure 24:
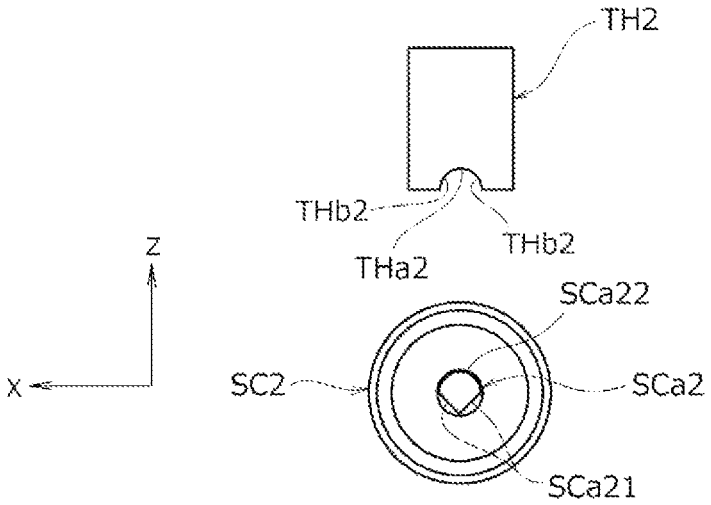
FIG. 24 is an explanatory front view showing a state in which a horn (or instead, a molding die) is disposed above a terminal portion of a center conductor (a signal wire) of the coaxial cable according to the example shown in FIG. 23 such that they face each other.

In the center conductor (the signal wire) SCa2 of the coaxial cable SC2 according to the example shown in FIGS. 23 and 24, a cross-sectional shape in a direction orthogonal to the extending direction (the positive-negative direction of the Y axis in the drawing) of the center conductor (the signal wire) SCa2 is a "fan shape." In some examples, the first surface portion SCa21 constituting a lower surface to be connected to the above-mentioned inner conductor contact (the signal contact member) 32 has two flat surfaces extending in the extending direction (the positive-negative direction of the Y axis in the drawing) of the center conductor (the signal wire) SCa2.

Each of the two flat surfaces constituting the first surface portion SCa21 extends in the positive-negative direction of the Y axis in the drawing in a state in which it is inclined in a direction intersecting with the extending direction (the positive-negative direction of the Y axis in the drawing) of the center conductor (the signal wire) SCa2 of the coaxial cable SC2, for example, in a direction intersecting therewith at about 45 degrees. Then, each of these two flat surfaces has two end edges constituted by one end edge and another end edge extending in the extending direction (the positive-negative direction of the Y axis in the drawing), and the one end edges of each flat surface are directly connected to each other.

Further, in the second surface portion SCa22 constituting an upper surface of the terminal portion of the center conductor (the signal wire) SCa2 of the coaxial cable SC2, a contour shape forming a cross section in a direction orthogonal to the extending direction (the positive-negative direction of the Y axis in the drawing) of the center conductor (the signal wire) SCa2 may be a single "curved surface," or for example, the "arc shape," and, in this cross section, the curved surface in a state in which it is curved in the "arc shape" extends in the extending direction (the positive-negative direction of the Y axis in the drawing) of the center conductor (the signal wire) SCa2. The both outermost end edges of the second surface portion SCa22 having such a cross-section of the "arc shape" in the radial direction orthogonal to the extending direction are directly connected to the outermost end edges of the above-described first surface portion SCa21 in the radial direction orthogonal to the extending direction.

As described above, a tip end surface (a lower end surface) of the horn TH2 (or instead, a molding die) constituting an upper surface of the center conductor (the signal wire) SCa2 of the coaxial cable SC2 having a cross-sectional shape of a "fan shape" has a recess THa2 constituted by a groove-shaped portion of which a cross-sectional shape in a direction orthogonal to the extending direction (the positive-negative direction of the Y axis in the drawing) of the center conductor (the signal wire) SCa2 of the coaxial cable SC2 is recessed in the "arc shape," as shown in FIG. 24, for example. In some examples, an interval between groove side wall portions THb2 and THb2 constituted by a curved surface of which a cross section is recessed in the arc shape and which constitutes the groove-shaped portion of the recess THa2 is set to be the maximum groove width at the groove opening at a lower end, and becomes continuously narrower in a curved shape in the upward direction from the groove opening toward the bottom portion of the groove-shaped portion.

If a cross-sectional shape of the recess THa2 provided in the tip end surface (the lower end surface) of the horn TH2 (or instead, a molding die) has a curved surface of the "arc shape," when performing the joining with ultrasonic vibration, the ultrasonic vibration is efficiently transmitted to the first surface portion SCa21 of the center conductor (the signal wire) SCa2 of the coaxial cable SC2 and the inner conductor contact (the signal contact member) 32 that will be described later via the groove side wall portion THb2 constituted by the arc shaped curved surface of the horn TH2.

Further, also in the center conductor (the signal wire) SCa2 of the coaxial cable SC2, the first surface portion SCa21 constituting the terminal portion of the center conductor (the signal wire) SCa2 may be connected to a connection portion 32*d* provided in the inner conductor contact (the signal contact member) 32 shown in FIGS. 29 and 30 to be placed from the "upper side" (in the positive direction of the Z axis in the drawing), while, in that time, since the two flat surfaces constituting the first surface portion SCa21 of the center conductor (the signal wire) SCa2 of the coaxial cable SC2 serve as a lower surface to be connected to the above-described inner conductor contact (the signal contact member) 32, a contact area between the center conductor (the signal wire) SCa2 of the coaxial cable SC2 and the inner conductor contact (the signal contact member) 32 increases, and thus sufficient joining strength may be obtained when performing the joining with ultrasonic vibration.

Figure 25:
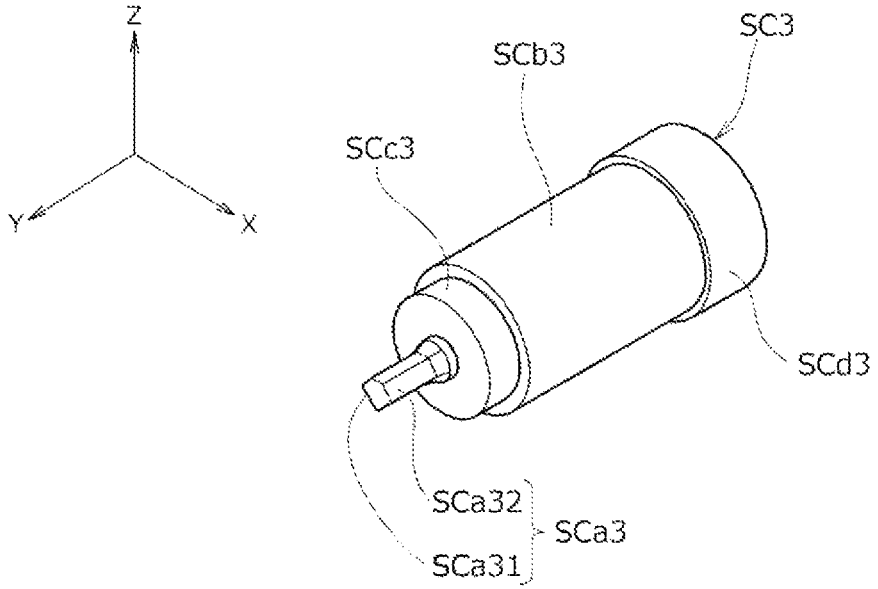
FIG. 25 is an explanatory external perspective view showing a terminal portion of a coaxial cable according to still another example, as viewed from the front upper side.
Figure 26:
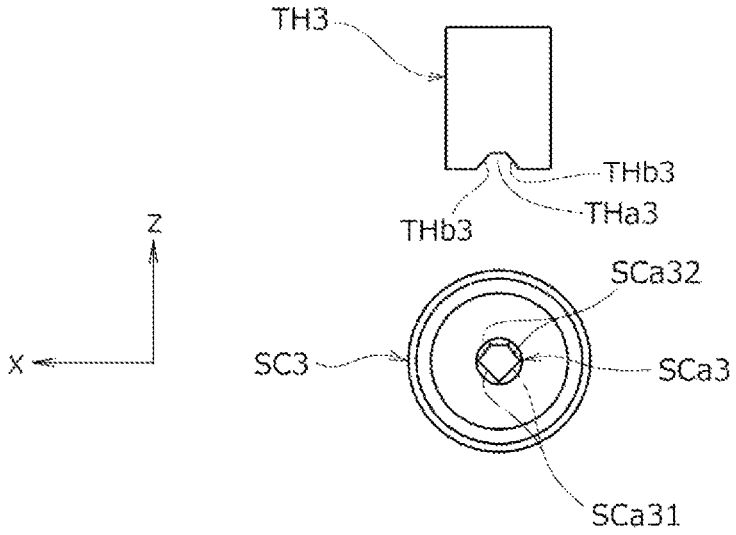
FIG. 26 is an explanatory front view showing a state in which a horn (or instead, a molding die) is disposed above a terminal portion of a center conductor (a signal wire) of the coaxial cable according to the example shown in FIG. 25 such that they face each other.

In the center conductor (the signal wire) SCa3 of the coaxial cable SC3 according to the example shown in FIGS. 25 and 26, a cross-sectional shape in a direction orthogonal to the extending direction of the center conductor (the signal wire) SCa3 is the "polygonal shape." In some examples, the first surface portion SCa31 of the center conductor (the signal wire) SCa3 constituting a lower surface to be connected to the above-mentioned inner conductor contact (the signal contact member) 32 has two flat surfaces extending in the extending direction (the positive-negative direction of the Y axis in the drawing) of the center conductor (the signal wire) SCa3. Further, the second surface portion SCa32 constituting an upper surface of the center conductor (the signal wire) SCa3 has three flat surfaces extending in the extending direction (the positive-negative direction of the Y axis in the drawing) of the center conductor (the signal wire) SCa3.

Then, each of the two flat surfaces constituting the first surface portion SCa31 of the above-described center conductor (the signal wire) SCa3 extends in the positive-negative direction of the Y axis in the drawing in a state in which it is inclined in a direction intersecting with the extending direction (the positive-negative direction of the Y axis in the drawing) of the center conductor (the signal wire) SCa3 of the coaxial cable SC3, for example, in a direction intersecting therewith at about 45 degrees. Then, each of these two flat surfaces has two end edges constituted by one end edge and another end edge extending in the extending direction (the positive-negative direction of the Y axis in the drawing), and the one end edges of each of the flat surfaces are directly connected to each other.

Further, each of the three flat surfaces constituting the second surface portion SCa32 of the center conductor (the signal wire) SCa3 also has two end edges constituted by one end edge and another end edge extending in the extending direction (the positive-negative direction of the Y axis in the drawing), and the one end edges of each of the flat surface are directly connected to each other.

As described above, a tip end surface (a lower end surface) of the horn TH3 (or instead, a molding die) constituting an upper surface of the center conductor (the signal wire) SCa3 of the coaxial cable SC3 having a cross-sectional shape of the "polygonal shape" has a recess THa3 constituted by a groove-shaped portion of which a cross-sectional shape in a direction orthogonal to the extending direction (the positive-negative direction of the Y axis in the drawing) of the center conductor (the signal wire) SCa3 of the coaxial cable SC3 is recessed in a "trapezoid shape," as shown in FIG. 26, for example. In some examples, an interval between groove side wall portions THb3 and THb3 constituted by a pair of tapered surfaces that constitutes the groove-shaped portion of the recess THa3 and face each other is set to be the maximum groove width at the groove opening at a lower end, and becomes continuously linearly narrower in the upward direction from the groove opening toward the bottom portion of the groove-shaped portion, and upper end edges of these groove side wall portions THb3 and THb3 are indirectly connected to each other via a separate flat surface THb3 extending substantially parallel to the above-described inner conductor contact (the signal contact member) 32.

The groove side wall portions THb3, THb3, and THb3 of the horn TH3 (or instead, a molding die) may be constituted by three flat surfaces extending in the "front-rear direction" (the positive-negative direction of the Y axis in the drawing), each of the three flat surfaces has two end edges constituted by one end edge and another end edge extending in the extending direction, and the one end edges of each of the two end edges are directly connected to each other.

In some examples, if a cross-sectional shape of the recess THa3 provided in the tip end surface (the lower end surface) of the horn TH3 (or instead, a molding die) has a "trapezoid shape," when performing the joining with ultrasonic vibration, the ultrasonic vibration is efficiently transmitted to the first surface portion SCa31 of the center conductor (the signal wire) SCa3 of the coaxial cable SC3 and the above-described inner conductor contact (the signal contact member) 32 via the groove side wall portions THb3, THb3, and THb3 constituted by the three flat surfaces of the horn TH3.

Further, also in the center conductor (the signal wire) SCa3 of the coaxial cable SC3, the first surface portion SCa31 constituting the terminal portion of the center conductor (the signal wire) SCa3 may be connected to a connection portion 32*d* provided in the inner conductor contact (the signal contact member) 32 shown in FIGS. 29 and 30 to be placed from the "upper side" (in the positive direction of the Z axis in the drawing), while, in that time, since the two flat surfaces constituting the first surface portion SCa31 of the center conductor (the signal wire) SCa3 of the coaxial cable SC3 serve as a lower surface to be connected to the inner conductor contact (the signal contact member) 32, a contact area between the center conductor (the signal wire) SCa3 of the coaxial cable SC3 and the inner conductor contact (the signal contact member) 32 increases, and thus sufficient joining strength may be obtained when performing the joining with ultrasonic vibration.

Figure 27:
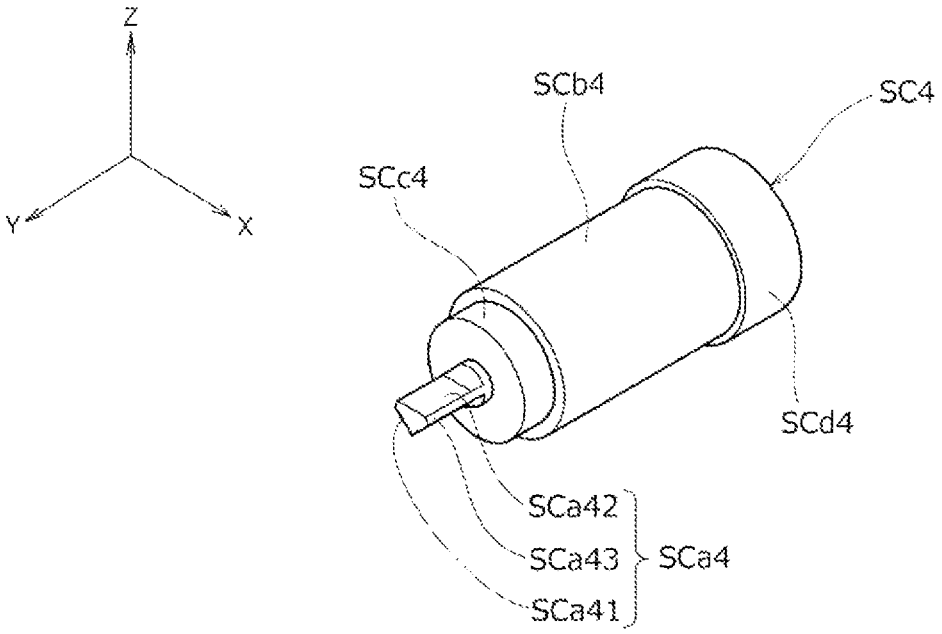
FIG. 27 is an explanatory external perspective view showing a terminal portion of a coaxial cable according to still another example, as viewed from the front upper side.
Figure 28:
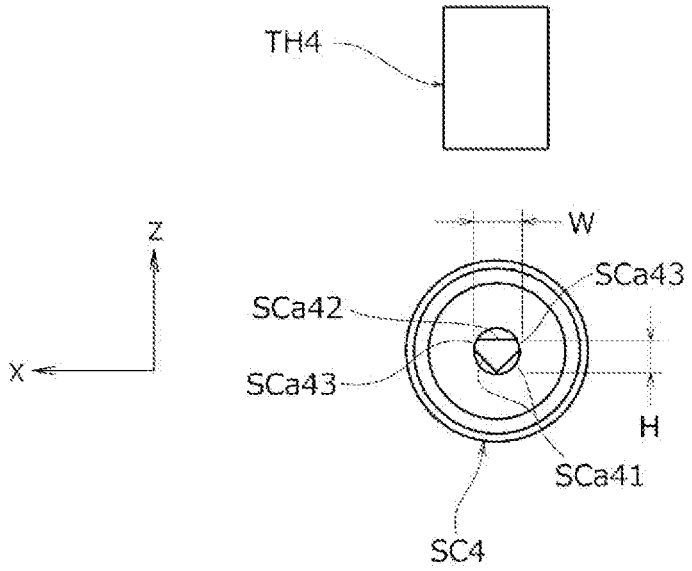
FIG. 28 is an explanatory front view showing a state in which a horn (or instead, a molding die) is disposed above a terminal portion of a center conductor (a signal wire) of the coaxial cable according to the example shown in FIG. 27 such that they face each other.

In the coaxial cable SC4 according to the example shown in FIGS. 27 and 28, a cross-sectional shape in a direction orthogonal to the extending direction (the positive-negative direction of the Y axis in the drawing) of the center conductor (the signal wire) SCa4 is the "polygonal shape," and the first surface portion SCa41 constituting a lower surface to be connected to the above-mentioned inner conductor contact (the signal contact member) 32 has two flat surfaces extending in the extending direction (the positive-negative direction of the Y axis in the drawing) of the center conductor (the signal wire) SCa4. Each of the two flat surfaces constituting the first surface portion SCa41 extends in the positive-negative direction of the Y axis in the drawing in a state in which it is inclined in a direction intersecting with the extending direction (the positive-negative direction of the Y axis in the drawing) of the center conductor (the signal wire) SCa4 of the coaxial cable SC4, for example, in a direction intersecting therewith at about 45 degrees. Then, each of these two flat surfaces has two end edges constituted by one end edge and another end edge extending in the extending direction (the positive-negative direction of the Y axis in the drawing), and the one end edges of each of the flat surfaces are directly connected to each other.

Further, the second surface portion SCa42 constituting an upper surface of the center conductor (the signal wire) SCa4 of the coaxial cable SC4 may have a single flat surface (a horizontal surface) extending in the extending direction (the positive-negative direction of the Y axis in the drawing) of the center conductor (the signal wire) SCa4, and the both outermost end edges of the single flat surface (the horizontal surface) in a width direction (the positive-negative direction of the X axis in the drawing) are indirectly connected to the both outermost end edges of the above-described first surface portion SCa41 via a pair of other surface portions SCa43 and SCa43.

Here, in the center conductor (the signal wire) SCa4 of the coaxial cable SC4, the maximum dimension H in the "vertical direction" (the positive-negative direction of the Z axis in the drawing) that is a direction in which the first surface portion SCa41 and the second surface portion SCa42 face each other may be smaller than the maximum dimension W in the "left-right direction" (the positive-negative direction of the X axis in the drawing) orthogonal to a direction in which the first surface portion SCa41 and the second surface portion SCa42 face each other (H<W). That is, in a cross section of the center conductor (the signal wire), a circular shape before processing is changed to a shape compressed in the "vertical direction" (the positive-negative direction of the Z axis in the drawing), while the compressing in the "vertical direction" (the positive-negative direction of the Z axis in the drawing) is the same in other examples.

As described above, a tip end surface (a lower end surface) of the horn TH4 (or instead, a molding die) constituting an upper surface of the center conductor (the signal wire) SCa4 of the coaxial cable SC4 having a cross-sectional shape of the "polygonal shape" is a flat surface having no recess as shown in FIG. 28, for example. The flat surface of the horn TH4 directly forms the first surface portion SCa41, and the amount of pressurization (the amount of pressing down) of the horn TH4 are appropriately adjusted, so that the above-described other surface portion SCa43 is formed.

Further, also in the center conductor (the signal wire) SCa4 of the coaxial cable SC4, the first surface portion SCa41 constituting the terminal portion of the center conductor (the signal wire) SCa4 may be connected to a connection portion 32*d* provided in the inner conductor contact (the signal contact member) 32 shown in FIGS. 29 and 30 to be placed from the "upper side" (in the positive direction of the Z axis in the drawing), while, in that time, since the two flat surfaces constituting the first surface portion SCa41 of the center conductor (the signal wire) SCa4 of the coaxial cable SC4 serve as a lower surface to be connected to the above-described inner conductor contact (the signal contact member) 32, a contact area between the center conductor (the signal wire) SCa4 of the coaxial cable SC4 and the inner conductor contact (the signal contact member) 32 increases, and thus sufficient joining strength may be obtained when performing the joining with ultrasonic vibration.

It is to be understood that not all aspects, advantages and features described herein may necessarily be achieved by, or included in, any one particular example. Indeed, having described and illustrated various examples herein, it should be apparent that other examples may be modified in arrangement and detail.

For example, the cross section of the center conductor (the signal wire) SCa of the coaxial cable SC in a direction orthogonal to the extending direction thereof may have any shape having at least three sides, and a side of a portion interposed by two sides of the three sides forming the cross-sectional shape may have an angular shape or may be a linear line or a curved line. Further, in the example shown in FIGS. 1 to 19, in a state in which the insulation housing 11 is already assembled to the shield shell 13, the contact assembly CA is attached to the insulation housing by the press-fitting. However, after the contact assembly CA is attached to the insulation housing 11, the insulation housing 11 with the contact assembly CA attached thereto may be assembled to the shield shell 13.

Further, in a case in which the insulation housing 21 is manufactured by the insert molding as in the example shown in FIG. 20, by employing the latter case in which, after the contact assembly CA is attached to the insulation housing 21, the insulation housing 21 with the contact assembly CA attached thereto is assembled to a shield shell 23, the mold structure can be simplified.

In some examples, a single-core coaxial cable connector is used. In other examples, a coaxial cable connector may include a plurality of inner conductor contacts disposed at a predetermined interval, or an electrical connector of a type in which a plurality of coaxial cables and insulation cables are mixed.

The examples described above may be applied to various electrical connectors used in various electric devices.

Although certain procedures or operations are described herein as being performed sequentially or in a particular order, in some examples one or more of the operations may be performed in a different order, in parallel, simultaneously with each other, or in an overlapping manner. Additionally, in some examples, one or more of the operations may be optionally performed or, in some cases, omitted altogether.

We claim all modifications and variations coming within the spirit and scope of the subject matter claimed herein.

Regarding the above embodiments, the following appendices are appended.

(Appendix 1) A method of manufacturing an electrical connector in which a signal transmission contact formed of a conductive member is attached to a housing formed of an insulation member, and a center conductor of a coaxial cable is connected to the contact, the method comprising:

a joining step with ultrasonic vibration of applying ultrasonic vibration in a state in which the center conductor of the coaxial cable is brought into contact with the contact before being attached to the housing to form a contact assembly in which the center conductor of the coaxial cable is joined to the contact; and an assembling step of attaching the contact of the contact assembly formed in the joining step with ultrasonic vibration to the housing.

(Appendix 2) The method of manufacturing an electrical connector according to appendix 1, wherein, in the assembling step, the contact of the contact assembly is attached to the housing by press-fitting.

(Appendix 3) The method of manufacturing an electrical connector according to appendix 1, wherein, in the assembling step, the housing is molded by insert molding after the contact assembly is set in a mold.

(Appendix 4) The method of manufacturing an electrical connector according to any one of appendices 1 to 3, wherein, in the joining step with ultrasonic vibration, a tip end surface of a horn is brought into contact with the center conductor of the coaxial cable, and an anvil is brought into contact with the contact, wherein ultrasonic vibration is applied in a state in which the contact and the center conductor of the coaxial cable are interposed between the horn and the anvil, and wherein a recess for accommodating the center conductor of the coaxial cable is provided in the tip end surface of the horn.

(Appendix 5) The method of manufacturing an electrical connector according to appendix 4, wherein the recess provided in the horn is formed as a groove-shaped portion extending in an extending direction of the center conductor of the coaxial cable, wherein the groove-shaped portion has a groove opening having a groove width corresponding to the center conductor of the coaxial cable and a pair of groove side wall portions extending in a state in which they face each other from the groove opening toward a groove bottom portion that is a bottom of the groove-shaped portion, and wherein, in the pair of groove side wall portions, an interval between the pair of groove side wall portions becomes narrower from the groove opening toward the groove bottom portion.

(Appendix 6) An electrical connector comprising:

a housing formed of an insulation member; and a contact formed of a conductive member to which a terminal portion of a center conductor of a coaxial cable is connected with application of ultrasonic vibration, and which is attached to the housing, wherein, in the terminal portion of the center conductor of the coaxial cable, a cross section in a direction orthogonal to an extending direction of the center conductor is a shape having at least three sides, wherein one side of the three sides constituting a cross-sectional shape of the terminal portion of the center conductor is connected to the contact, and wherein, in a pair of other sides extending from both ends of the one side, an interval between the pair of other sides becomes narrower away from the contact.

(Appendix 7) An electrical connector comprising:

a housing formed of an insulation member; and a contact formed of a conductive member to which a terminal portion of a center conductor of a coaxial cable in an extending direction thereof is connected with application of ultrasonic vibration, and which is attached to the housing, wherein the terminal portion of the center conductor of the coaxial cable has a first surface portion and a second surface portion which face each other in a direction orthogonal to the extending direction of the center conductor, wherein one of the first surface portion and the second surface portion is connected to the contact, wherein the first surface portion includes a single or a plurality of flat surfaces extending in the extending direction, and wherein the second surface portion includes a single or a plurality of flat surfaces extending in the extending direction, or a single or a plurality of curved surfaces extending in the extending direction.

(Appendix 8) The electrical connector according to appendix 7, wherein each of the plurality of flat surfaces constituting the first surface portion has one end edge and another end edge extending in the extending direction, and wherein the one edges of each of the flat surfaces are directly connected to each other or are indirectly connected to each other via another surface portion.

(Appendix 9) The electrical connector according to appendix 7, wherein the first surface portion is constituted by two flat surfaces extending in a state in which they are inclined in a direction intersecting with the extending direction, wherein each of the two flat surfaces constituting the first surface portion has one end edge and another end edge extending in the extending direction, and wherein the one edges of each of the two flat surfaces are directly connected to each other.

(Appendix 10) The electrical connector according to appendix 7, wherein each of the plurality of flat surfaces or curved surfaces constituting the second surface portion has one end edge and another end edge extending in the extending direction, and wherein the one edges of each of the flat surfaces or curved surfaces are directly connected to each other or are indirectly connected to each other via another surface portion.

(Appendix 11) The electrical connector according to appendix 7, wherein both outermost end edges of the first surface portion in a direction orthogonal to the extending direction and both outermost end edges of the second surface portion in a direction orthogonal to the extending direction are directly connected to each other or are indirectly connected to each other via another surface portion.

(Appendix 12) The electrical connector according to appendix 7, wherein, in the center conductor of the coaxial cable, a maximum dimension H in a direction in which the first surface portion and the second surface portion face each other is smaller than a maximum dimension W in a direction orthogonal to the direction in which the first surface portion and the second surface portion face each other (H<W).

(Appendix 13) The electrical connector according to appendix 7, wherein the contact has a connection portion to which the center conductor of the coaxial cable is connected, and wherein the connection portion has a groove portion extending in the extending direction.

(Appendix 14) The electrical connector according to appendix 13, wherein, in the groove portion of the contact, a cross section in a direction orthogonal to the extending direction has any one of a V shape, an arc shape, or a polygonal shape.

(Appendix 15) The electrical connector according to any one of appendices 6 to 14, wherein the contact has gold plating at a portion to which the center conductor of the coaxial cable is connected, and wherein the terminal portion of the center conductor of the coaxial cable has silver plating at a portion to be connected to the gold plating of the contact.

(Appendix 16) The electrical connector according to any one of appendices 6 to 14, wherein a connection portion between the contact and the center conductor of the coaxial cable is embedded in the housing.

(Appendix 17) The electrical connector according to any one of appendices 6 to 16, wherein a shield shell formed of a conductive member which is disposed to cover an outer surface of the housing is attached to the housing and the shield shell is electrically connected to an outer conductor of the coaxial cable, wherein the contact is an inner conductor contact disposed in a region covered with the shield shell, and wherein a wire connection portion that is an electrical connection portion between the inner conductor contact and the terminal portion of the center conductor of the coaxial cable is disposed in the region of the shield shell.

What is claimed is:

1. A method of manufacturing an electrical connector comprising:

contacting an end portion of a center conductor exposed in an end portion of a coaxial cable having the center conductor with a conductive contact in a state where the contact is not in contact with an insulation housing for accommodating the contact;

applying ultrasonic vibration to the end portion of the center conductor and the contact in a state where the contact is not in contact with the insulation housing to join the end portion of the center conductor and the contact to each other; and accommodating, after the end portion of the center conductor and the contact are joined to each other, the contact in the insulation housing so that the contact comes in contact with the insulation housing, and covering at least a part of a joint of the end portion of the center conductor and the contact with the insulation housing, wherein applying the ultrasonic vibration to the end portion of the center conductor and the contact comprises:

sandwiching the end portion of the center conductor and the contact between a horn in contact with the end portion of the center conductor and an anvil in contact with the contact; and applying the ultrasonic vibration to the horn while the end portion of the center conductor and the contact are sandwiched between the horn and the anvil, wherein the method further comprises pressing the end portion of the center conductor and the contact by the horn and the anvil such that a cross section of the end portion of the center conductor is plastically deformed from a circular shape to a non-circular shape while the ultrasonic vibration is applied to the horn, wherein the contact has a joint surface, wherein the horn has a pressing groove and an inner surface of the pressing groove, wherein applying the ultrasonic vibration to the end portion of the center conductor and the contact comprises applying the ultrasonic vibration to the horn while the end portion of the center conductor fits into the pressing groove, the end portion of the center conductor is in contact with the joint surface, and the anvil is in contact with a back surface of the joint surface, and wherein pressing the end portion of the center conductor and the contact comprises forming, by pressing, a formed outer surface along the inner surface of the pressing groove on an outer peripheral surface of the end portion of the center conductor, and a formed joint surface along the joint surface on the outer peripheral surface of the end portion of the center conductor.

2. The method according to claim 1, wherein covering at least the part of the joint of the end portion of the center conductor and the contact with the insulation housing comprises covering the back surface of the joint surface with the insulation housing.

3. The method according to claim 1, wherein at least part of the formed joint surface is substantially flat.

4. The method according to claim 1, wherein at least part of the formed outer surface is substantially flat.

5. The method according to claim 1, wherein the joint surface is coated with a first film containing gold, wherein the outer peripheral surface of the end portion of the center conductor is coated with a second film containing silver, and wherein applying the ultrasonic vibration to the end portion of the center conductor and the contact comprises solid-phase joining the first film and the second film by applying the ultrasonic vibration to the horn in a state where the first film is in contact with the second film.

6. The method according to claim 1, wherein the inner surface of the pressing groove has a first pressing surface and a second pressing surface that gradually approach each other toward a bottom of the pressing groove, wherein applying the ultrasonic vibration to the end portion of the center conductor and the contact comprises applying the ultrasonic vibration to the horn while the outer peripheral surface of the end portion of the center conductor is in contact with the first pressing surface and the second pressing surface, and wherein pressing the end portion of the center conductor and the contact comprises forming the formed outer surface including a first formed outer surface along the first pressing surface and a second formed outer surface along the second pressing surface on the outer peripheral surface of the end portion of the center conductor by pressing.

7. The method according to claim 6, wherein at least part of the first formed outer surface is substantially flat, and wherein at least part of the second formed outer surface is substantially flat.

8. The method according to claim 1, wherein accommodating the contact in the insulation housing and covering at least the part of the joint of the end portion of the center conductor and the contact with the insulation housing comprises press fitting the contact to the insulation housing.

9. The method according to claim 8, wherein the insulation housing has a cavity, and wherein covering at least the part of the joint of the end portion of the center conductor and the contact with the insulation housing comprises accommodating the contact in the cavity of the insulation housing.

10. The method according to claim 1, wherein accommodating the contact in the insulation housing and covering at least the part of the joint of the end portion of the center conductor and the contact with the insulation housing comprises putting the contact into a mold and injecting a molten resin into the mold to mold the insulation housing.

11. The method according to claim 10, wherein injecting the molten resin into the mold to mold the insulation housing comprises wrapping the joint of the end portion of the center conductor and the contact with the molten resin to bury the joint of the end portion of the center conductor and the contact in the insulation housing.

12. The method according to claim 1, wherein the contact has a joint groove and an inner surface of the joint groove includes the joint surface, wherein applying the ultrasonic vibration to the end portion of the center conductor and the contact comprises applying the ultrasonic vibration to the horn while the outer peripheral surface of the end portion of the center conductor is in contact with the inner surface of the joint groove, and wherein pressing the end portion of the center conductor and the contact comprises forming the formed joint surface along the inner surface of the joint groove on the outer peripheral surface of the end portion of the center conductor by pressing.

13. The method according to claim 12, wherein the joint surface includes a first joint surface and a second joint surface that gradually approach each other toward a bottom of the joint groove, wherein applying the ultrasonic vibration to the end portion of the center conductor and the contact comprises applying the ultrasonic vibration to the horn while the outer peripheral surface of the end portion of the center conductor is in contact with the first joint surface and the second joint surface, and wherein pressing the end portion of the center conductor and the contact comprises forming the formed joint surface including a first formed joint surface along the first joint surface and a second formed joint surface along the second joint surface on the outer peripheral surface of the end portion of the center conductor by pressing.

14. The method according to claim 13, wherein the anvil has a supporting groove and an inner surface of the supporting groove includes a first supporting surface and a second supporting surface that gradually approach each other toward a bottom of the supporting groove, and wherein pressing the end portion of the center conductor and the contact comprises pressing the end portion of the center conductor and the contact by the horn and the anvil while the first supporting surface faces a back surface of the first joint surface and the second supporting surface faces a back surface of the second joint surface.

15. The method according to claim 13, wherein at least part of the first formed joint surface is substantially flat, and wherein at least part of the second formed joint surface is substantially flat.

16. A method of manufacturing an electrical connector comprising:

contacting an end portion of a center conductor exposed in an end portion of a coaxial cable having the center conductor with a conductive contact in a state where the contact is not in contact with an insulation housing for accommodating the contact;

applying ultrasonic vibration to the end portion of the center conductor and the contact in a state where the contact is not in contact with the insulation housing to join the end portion of the center conductor and the contact to each other; and accommodating, after the end portion of the center conductor and the contact are joined to each other, the contact in the insulation housing so that the contact comes in contact with the insulation housing, and covering at least a part of a joint of the end portion of the center conductor and the contact with the insulation housing, wherein applying the ultrasonic vibration to the end portion of the center conductor and the contact comprises:

sandwiching the end portion of the center conductor and the contact between a horn in contact with the end portion of the center conductor and an anvil in contact with the contact; and applying the ultrasonic vibration to the horn while the end portion of the center conductor and the contact are sandwiched between the horn and the anvil, wherein the method further comprises pressing the end portion of the center conductor and the contact by the horn and the anvil such that a cross section of the end portion of the center conductor is plastically deformed from a circular shape to a non-circular shape while the ultrasonic vibration is applied to the horn, wherein the contact has a joint groove and an inner surface of the joint groove, wherein applying the ultrasonic vibration to the end portion of the center conductor and the contact comprises applying the ultrasonic vibration to the horn while an outer peripheral surface of the end portion of the center conductor is in contact with the inner surface of the joint groove, and the anvil is in contact with a back surface of the inner surface, and wherein pressing the end portion of the center conductor and the contact comprises forming a formed joint surface along the inner surface of the joint groove on the outer peripheral surface of the end portion of the center conductor by pressing.

17. The method according to claim 16, wherein the joint surface includes a first joint surface and a second joint surface that gradually approach each other toward a bottom of the joint groove, wherein applying the ultrasonic vibration to the end portion of the center conductor and the contact comprises applying the ultrasonic vibration to the horn while the outer peripheral surface of the end portion of the center conductor is in contact with the first joint surface and the second joint surface, and wherein pressing the end portion of the center conductor and the contact comprises forming the formed joint surface including a first formed joint surface along the first joint surface and a second formed joint surface along the second joint surface on the outer peripheral surface of the end portion of the center conductor by pressing.

18. The method according to claim 17, wherein the anvil has a supporting groove and an inner surface of the supporting groove includes a first supporting surface and a second supporting surface that gradually approach each other toward a bottom of the supporting groove, and wherein pressing the end portion of the center conductor and the contact comprises pressing the end portion of the center conductor and the contact by the horn and the anvil while the first supporting surface faces a back surface of the first joint surface and the second supporting surface faces a back surface of the second joint surface.

19. A method of manufacturing an electrical connector comprising:

contacting an end portion of a center conductor exposed in an end portion of a coaxial cable having the center conductor with a conductive contact in a state where the contact is not in contact with an insulation housing for accommodating the contact;

applying ultrasonic vibration to the end portion of the center conductor and the contact in a state where the contact is not in contact with the insulation housing to join the end portion of the center conductor and the contact to each other; and accommodating, after the end portion of the center conductor and the contact are joined to each other, the contact in the insulation housing so that the contact comes in contact with the insulation housing, and covering at least a part of a joint of the end portion of the center conductor and the contact with the insulation housing, wherein applying the ultrasonic vibration to the end portion of the center conductor and the contact comprises:

sandwiching the end portion of the center conductor and the contact between a horn in contact with the end portion of the center conductor and an anvil in contact with the contact; and applying the ultrasonic vibration to the horn while the end portion of the center conductor and the contact are sandwiched between the horn and the anvil, wherein the method further comprises pressing the end portion of the center conductor and the contact by the horn and the anvil such that a cross section of the end portion of the center conductor is plastically deformed from a circular shape to a non-circular shape while the ultrasonic vibration is applied to the horn, wherein the contact has a joint surface, wherein applying the ultrasonic vibration to the end portion of the center conductor and the contact comprises applying the ultrasonic vibration to the horn while the end portion of the center conductor is in contact with the joint surface and the anvil is in contact with a back surface of the joint surface, wherein pressing the end portion of the center conductor and the contact comprises forming a formed joint surface along the joint surface on an outer peripheral surface of the end portion of the center conductor by pressing, and wherein the joint surface is coated with a first film containing gold, wherein the outer peripheral surface of the end portion of the center conductor is coated with a second film containing silver, and wherein applying the ultrasonic vibration to the end portion of the center conductor and the contact comprises solid-phase joining the first film and the second film by applying the ultrasonic vibration to the horn in a state where the first film is in contact with the second film.

* * * * *